US011591900B2

(12) United States Patent
Wessling et al.

(10) Patent No.: US 11,591,900 B2
(45) Date of Patent: Feb. 28, 2023

(54) METHOD TO PREDICT OVERPRESSURE UNCERTAINTY FROM NORMAL COMPACTION TRENDLINE UNCERTAINTY

(71) Applicants: Stefan Wessling, Hannover (DE); Anne Bartetzko, Celle (DE); Philipp Tesch, Berlin (DE)

(72) Inventors: Stefan Wessling, Hannover (DE); Anne Bartetzko, Celle (DE); Philipp Tesch, Berlin (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 47 days.

(21) Appl. No.: 17/370,419

(22) Filed: Jul. 8, 2021

(65) Prior Publication Data

US 2021/0332694 A1 Oct. 28, 2021

Related U.S. Application Data

(63) Continuation of application No. 14/031,877, filed on Sep. 19, 2013, now abandoned.

(60) Provisional application No. 61/703,567, filed on Sep. 20, 2012.

(51) Int. Cl.
*E21B 47/06* (2012.01)
*E21B 21/08* (2006.01)

(52) U.S. Cl.
CPC ..... *E21B 47/06* (2013.01); *E21B 21/08* (2013.01)

(58) Field of Classification Search
CPC ..... E21B 47/06; E21B 21/08; E21B 49/00
See application file for complete search history.

(56) References Cited

U.S. PATENT DOCUMENTS 5,128,866 A * 7/1992 Weakley ..... E21B 47/06 702/14
5,282,384 A * 2/1994 Holbrook ..... E21B 21/08 73/382 R
5,615,115 A * 3/1997 Shilling ..... E21B 49/006 702/9
6,766,254 B1 7/2004 Bradford et al.
6,826,486 B1 * 11/2004 Malinverno ..... E21B 49/006 702/9
7,349,807 B2 3/2008 Moos et al.
7,653,563 B2 1/2010 Veeningen et al.
7,698,065 B2 4/2010 Moos et al.
(Continued)

OTHER PUBLICATIONS

Malinverno et al., Integrating Diverse Measurements to Predict Pore Pressure with Uncertainties while drillin; 2004; Society of Pteroleum Engineers Inc.; 11 pages.

(Continued)

*Primary Examiner* — Eyob Hagos
(74) *Attorney, Agent, or Firm* — Cantor Colburn LLP

(57) ABSTRACT

A method for predicting a pressure window for drilling a borehole in a formation includes: obtaining a pore pressure related data value of the formation using a data acquisition tool; predicting pore pressure uncertainty from the pore pressure related data value of the formation using a processor; estimating uncertainty of a pressure window for drilling fluid using the predicted pore pressure uncertainty using a processor; and applying the estimated uncertainty to the pressure window to provide a modified pressure window using a processor.

25 Claims, 17 Drawing Sheets

(56) References Cited

U.S. PATENT DOCUMENTS

2002/0112888 A1* 8/2002 Leuchtenberg ..... E21B 21/08 175/48
2005/0197780 A1 9/2005 Moos et al.
2007/0007041 A1* 1/2007 Krueger ..... E21B 21/08 175/57
2007/0038377 A1* 2/2007 Sayers ..... G01V 1/30 702/9
2007/0118292 A1* 5/2007 Moos ..... G01V 1/30 702/14
2008/0033704 A1* 2/2008 Sayers ..... E21B 47/06 703/10
2008/0052003 A1* 2/2008 Moos ..... G01V 1/30 702/11
2010/0000791 A1* 1/2010 Alberty ..... G01V 3/20 175/45
2010/0305865 A1 12/2010 Bachrach et al.
2012/0097450 A1 4/2012 Wessling et al.
2012/0199397 A1 8/2012 Westling et al.
2013/0066558 A1* 3/2013 Wessling ..... G01V 9/00 702/9
2013/0144531 A1* 6/2013 Johnston ..... E21B 44/00 702/9
2014/0076632 A1 3/2014 Wessling et al.

OTHER PUBLICATIONS

Notification of Transmittal of the International Search Report and the Written Opinion of the International Searching Authority, or the Declaration; PCT/US2013/060802; dated Dec. 24, 2013.

Wessling et al., "Quantification of uncertainty in a multistage/multiparameter modelingworkflow: Pore pressure from geophysical well logs", Geophysics, vol. 78, No. 3 (May-Jun. 2013); p. WB101-WB112, GEO2012-0402.1.

* cited by examiner

METHOD TO PREDICT OVERPRESSURE UNCERTAINTY FROM NORMAL COMPACTION TRENDLINE UNCERTAINTY

CROSS-REFERENCE TO RELATED APPLICATIONS

This application is a continuation of U.S. application Ser. No. 14/031,877 filed Sep. 19, 2013, the disclosure of which is incorporated by reference herein in its entirety.

BACKGROUND

Geologic formations are used for many purposes such as hydrocarbon production, geothermal production and carbon dioxide sequestration. Boreholes are typically drilled into the earth in order to access the formations. Prior to a borehole being drilled, forces or loads in the rock mass of a formation are substantially in equilibrium with each other. Keeping the drilled formation stable generally requires a support pressure be applied by drilling mud in the borehole. The proper support pressure is related to the pressure of the formation fluid in the pores of the formation (i.e., pore pressure). If the applied support pressure is insufficient, the formation surrounding the borehole may become unstable and collapse into the borehole damaging equipment and causing costly delays, or formation fluid may enter into the wellbore causing a kick or even a blowout.

During drilling, the pressure of the drilling mud is maintained within a pressure window, for instance by a mud program. It is important that the pressure window is accurately determined in order to efficiently drill the borehole and prevent damage. Hence, it would be well received in the drilling industry if estimates of pore pressure were provided with an uncertainty that could be used as input to the mud program in order for the pressure window to compensate for the uncertainty. In particular, it would be well received if the pore pressure and associated uncertainty could be predicted ahead of the drill bit, i.e., before the formation is drilled.

BRIEF SUMMARY

Disclosed is a method for predicting a pressure window for drilling a borehole in a formation The method includes: obtaining a pore pressure related data value of the formation using a data acquisition tool; predicting pore pressure uncertainty from the pore pressure related data value of the formation using a processor; estimating uncertainty of a pressure window for drilling fluid using the predicted pore pressure uncertainty using a processor; and applying the estimated uncertainty to the pressure window to provide a modified pressure window using a processor.

Also disclosed is an apparatus for predicting a pore pressure window for drilling a borehole in a formation. The apparatus includes a data acquisition tool configured to perform formation measurements related to pore pressure of the formation at a plurality of depths in the borehole and a processor in communication with the downhole tool. The processor is configured to implement a method comprising at least one of the steps: obtaining a pore pressure related data value of the formation from the data acquisition tool; predicting pore pressure uncertainty from the pore pressure related data value of the formation; estimating uncertainty of a pressure window for drilling fluid using the predicted pore pressure uncertainty; and applying the estimated uncertainty to the pressure window to provide a modified pressure window.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Figure 1:
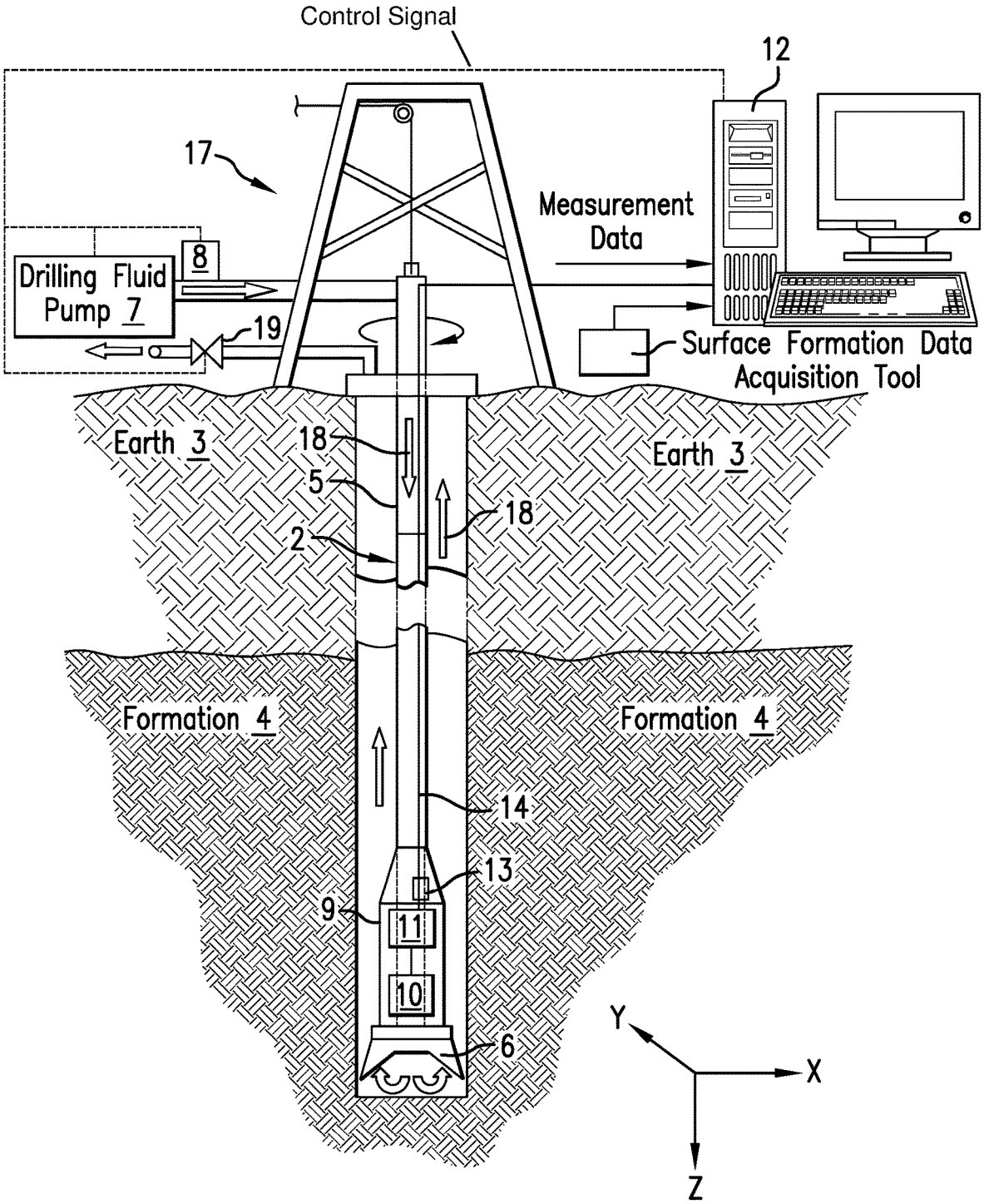
FIG. 1 illustrates an exemplary embodiment of a downhole porosity tool disposed in a borehole penetrating the earth.

FIG. 1 illustrates an exemplary embodiment of a bottom hole assembly (BHA) 9 disposed in a borehole 2 penetrating the earth 3, which includes an earth formation 4. The BHA 9 is conveyed through the borehole 2 by a drill string 5 for logging-while-drilling and/or steering applications. The drill string may represent any drill tubular for drilling a borehole such as coiled tubing drill pipes, or other equipment known in the art. A drill bit 6 is disposed at the distal end of the BHA 9 for drilling the borehole 2. The BHA and the drill bit together may be referred to as a drilling tool. A drill rig 17 rotates the drill string 5 to drill the borehole 2 and pumps drilling fluid 18 through the drill string 5 in order to lubricate the drill bit 6 and flush cuttings from the borehole 2. A drilling fluid pump 7 is configured to pump the drilling fluid 18 at a selected pressure or flow rate that may be controlled by a controller. A flow sensor 8 configured to sense the flow rate of the drilling fluid 18 may provide input to the controller for feedback control. Pressure in the borehole annulus may also be controlled by a flow control valve 19, which is configured to control the flow of the drilling fluid 18 exiting the borehole 2. The flow control valve 19 may also be controller by the controller. A downhole tool 10 is disposed at (i.e., in or on) the BHA 9 and configured to perform measurements of the formation 4 at various depths to produce a measurement log. In one or more embodiments, the downhole formation measurements are related to the pore pressure of the formation 4. That is the pore pressure of the formation 4 can be deduced absolutely or relatively from those measurements. Non-limiting embodiments of those formation measurements include gamma ray measurements, resistivity measurements, dielectric measurements, acoustic measurements, nuclear magnetic resonance measurements, pulsed neutron measurements, and density and/or porosity measurements using a radiation source. In addition, in one or more embodiments, one or more downhole tools 10 may be configured to discriminate or identify the presence of shale in the formation 4 by natural gamma-ray logging in order to apply the methods disclosed herein.

Still referring to FIG. 1, a downhole electronic unit 11 is disposed in the BHA 9. The downhole electronic unit 11 is configured to operate the downhole tool 10 and/or process measurement data. In one or more embodiments, raw or processed measurement data can be transmitted to a computer processing system 12 disposed at the surface of the earth 3 via a telemetry system 13. The telemetry system 13 can be wired drill pipe 14, electromagnetic telemetry, acoustic telemetry, mud pulses or mud waves for real time communications as non-limiting examples. Data processing functions can be performed by the downhole electronic unit 11, the computer processing system 12 or some combination of both. In one or more embodiments, the computer processing system 12 is configured to be the controller that controls the drilling fluid pump 7 and/or the flow control valve 19.

The downhole electronic unit 11 and/or the computer processing system 12 includes a processor for executing algorithms that partly or completely implement a method for estimating the pore pressure of the formation 4 as a function of depth or time and an associated statistical or deterministic parameter such as an absolute or relative standard deviation, variance, minimum and maximum values, one or moments of a frequency distribution of a part of the data set or any other parameter to quantify the uncertainty of the pore pressure estimation. The pore pressure and its uncertainty parameter may then be provided to a mud program for maintaining the drilling fluid pressure within the pressure window.

Figure 2:
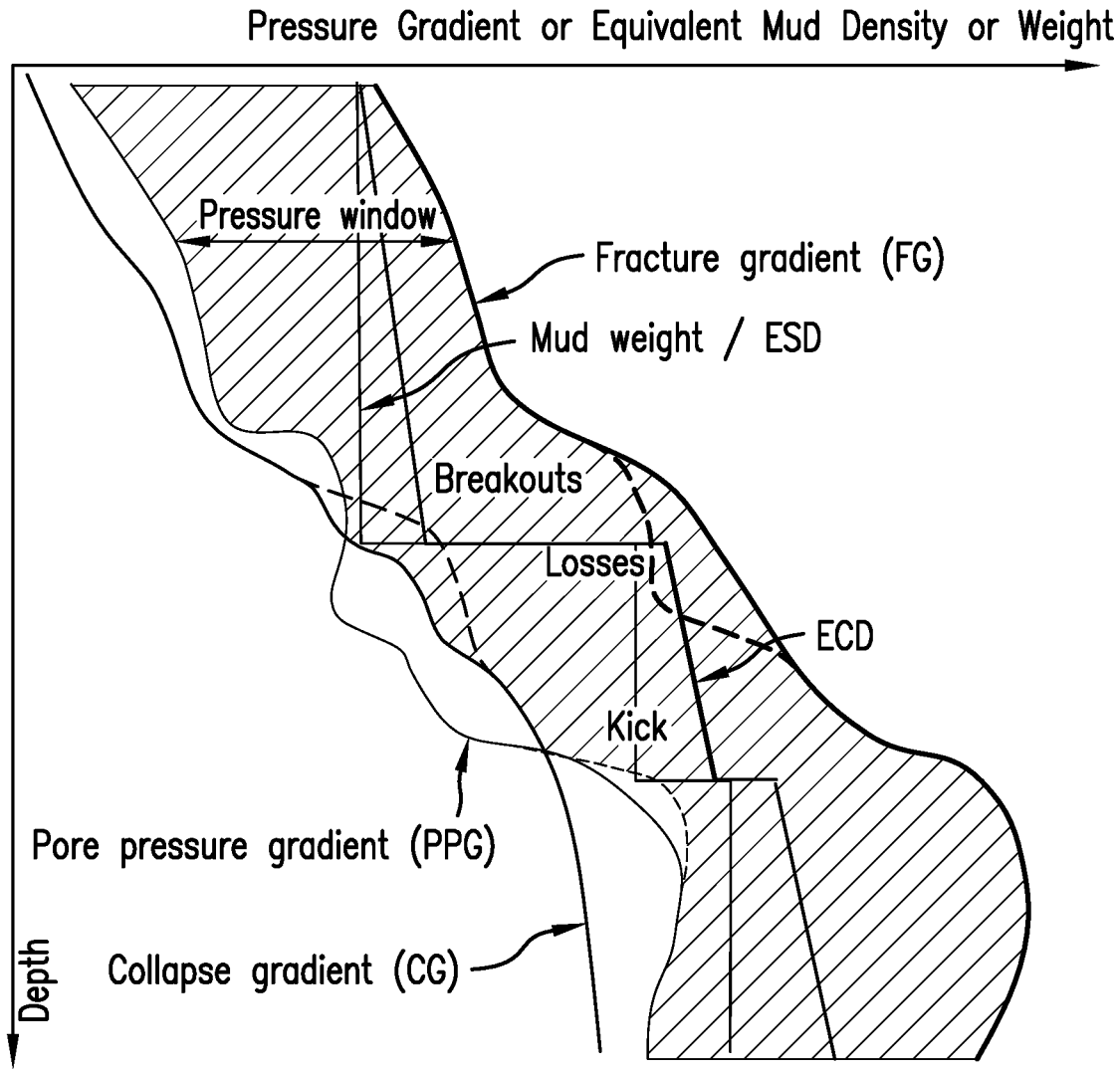
FIG. 2 illustrates an exemplary pressure window for drilling operations.

The drilling pressure window is depicted in FIG. 2 and is the acceptable range of pressures established in the borehole annulus along the open hole section. Although not required, FIG. 2 shows the pressure gradients instead of the pressures as it is commonly known in the industry. Factors that are part of establishing the drilling pressure include drilling fluid weight (or mud weight) and flow rate of the drilling fluid. In one or more embodiments, the flow rate may be determined by the speed or output pressure of the drilling fluid pump and/or by the position of a valve through which drilling fluid exits the borehole, sometimes referred to as managed pressure drilling. The pressure window is defined by its upper and lower bounds. The upper bound of the pressure window is the fracture gradient. There are two lower bounds of the pressure window. One lower bound is the pore pressure gradient while the other lower bound is the collapse gradient. The pressure window is below the upper bound and above the highest of the two lower bounds. For some established methods, the pore pressure gradient is an input-factor for determining the fracture gradient and the collapse gradient. Hence, pore pressure gradient uncertainty is an input to determining fracture gradient uncertainty, and collapse gradient uncertainty and, thus, to determining the drilling pressure window uncertainty. In one or more embodiments, the drilling pressure window uncertainty reduces the drilling pressure window by the amount of the uncertainty.

Appropriate drilling is realized as long as the downhole annular pressure prevailing along the open hole section is maintained within the pressure window. In FIG. 2, equivalent descriptions for the downhole annular pressure are the mud weight (or equivalent static density, ESD) for flow-off (non-circulating) conditions, and the equivalent circulating density (ECD) for circulating conditions.

If the downhole annular pressure prevailing along the open hole section of a borehole exceeds the fracture gradient, fractures are created at the borehole wall which eventually propagate further into the formation. Drilling fluid then penetrates into these drilling-induced fractures causing losses of drilling fluid. If the downhole annular pressure falls below the pore pressure gradient, formation fluid unintentionally enters into the borehole which is referred to as a kick. If the kick becomes uncontrollable, a blowout may occur. If the downhole annular pressure falls below the collapse gradient, the re-distributed stresses around the wellbore may exceed the compressive strength of the formation rock causing a collapse of the wellbore wall which can result in washouts, breakouts or even total collapse of the borehole. This disclosure discusses the pore pressure gradient in detail, but the other two pressure window bounds are also affected.

Before the pore pressure uncertainty method is discussed in detail, certain terms related to sedimentary compaction are presented. Pore pressure in the underground can be hydrostatic, overpressured, or underpressured compared to hydrostatic conditions, and different mechanisms exist that can cause a deviation of the pore pressure from hydrostatic. One such mechanism is based on the compaction of sedimentary material which is transported into sedimentary basins. Compaction is referred to as the decrease of porosity of fine or coarse sedimentary material due to burial of the settled material eventually with addition of further material.

Under normal conditions, fluid existing in the pore space in the sedimentary material will be squeezed out of the material, so that the porosity of the sediment will decrease with increasing load from above. This mechanism of normal compaction results in a hydrostatic pore pressure distribution. Assuming that compaction is the main pore pressure generating mechanism, overpressure (also referred to as undercompaction) is generated whenever fluid within the pore space is trapped with continuous burial of the sediment.

During the drilling operation, the compaction trend of sediments can be monitored for instance by inspection of pore pressure related logs (i.e., logs influenced by pore pressure) or drilling curves. Logs can be the resistivity, dielectric permittivity, acoustic slowness of the formation, bulk density, neutron porosity, gamma ray, nuclear magnetic resonance or others. A drilling curve example is the drilling exponent (DXC).

Using the resistivity log as an example, an overpressure zone is indicated by a decrease in resistivity from what would be expected in a normal compaction zone (i.e., a trend of an increase in resistivity with increasing depth as porosity decreases). Within the spirit of this invention, the term porosity is not limited to pores within the formation, but to any type of void space including fractures, etc. In one or more embodiments, the disclosed techniques for estimating pore pressure and associated uncertainty are applied only to shale in shale containing formations. Hence, in these embodiments, the pore pressure related formation measurements are filtered to exclude measurements performed on non-shale portions of the formation.

If undercompaction is the main overpressure generating mechanism, one step in the pore pressure modeling workflow might be the determination of the normal compaction trendline which describes the change in porosity with depth under normal compaction conditions. A deviation between the normal compaction trendline and acquired porosity-indicating data can be used to calculate the deviation from normal pressure regimes.

The normal compaction trendline is defined by establishing a line in a plot of pore pressure related logs versus depth. This step is typically performed manually. An alternative which will be explained later in more detail is performing a linear regression (using a processor) over the normally compacted depth interval. However, the regression conducted over different intervals will give different trendlines, depending on the variability of the pore pressure related logs. For example, acoustic slowness logs were noted to be much smoother in the normal compaction zone compared to formation resistivity logs. Note that the other variables such as OBG, $PP_n$, and the Eaton exponent (x) (which are discussed below) are also affected by some uncertainty, and that the uncertainty of the pore pressure related log depends on the measurement precision.

Figure 3:
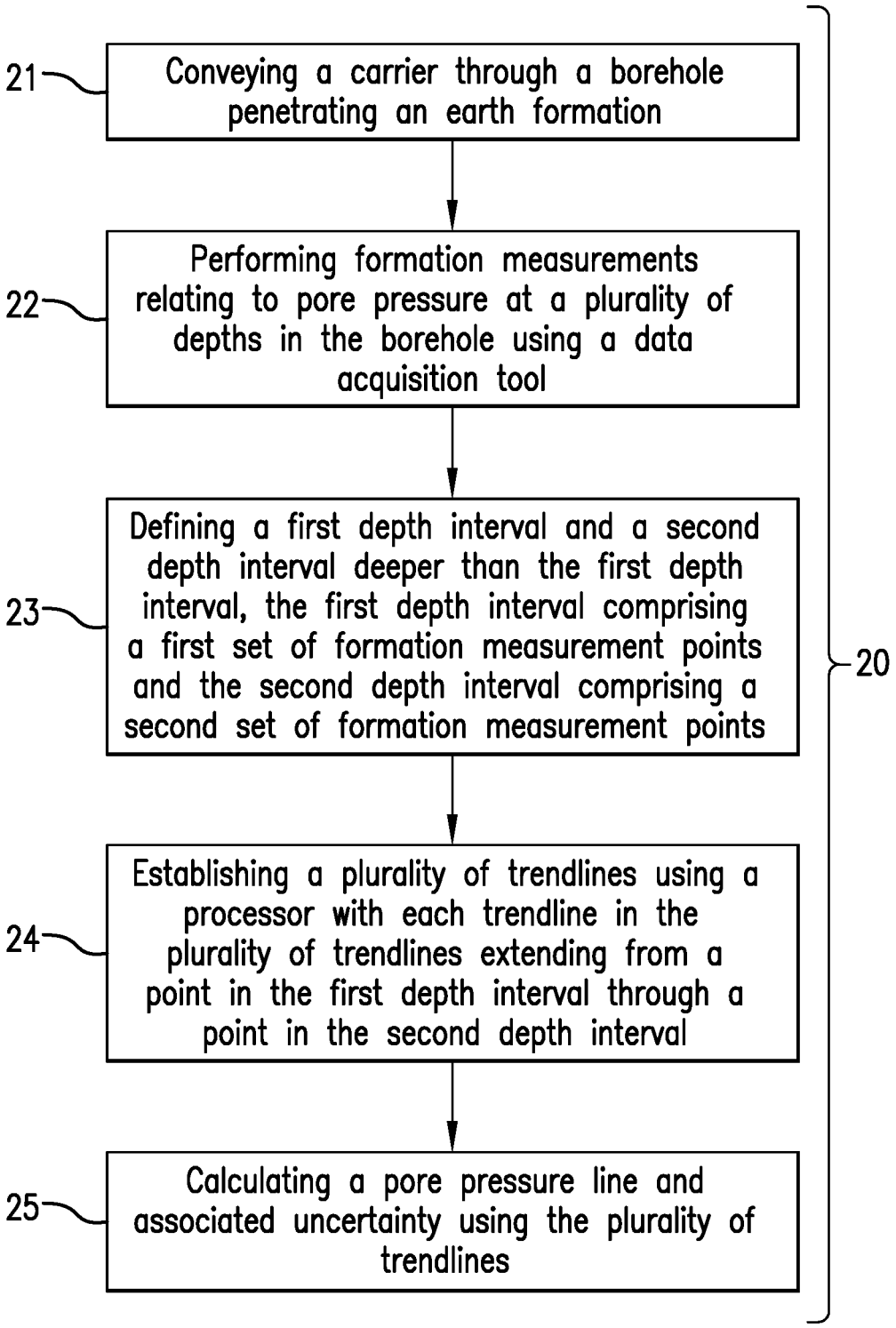
FIG. 3 presents a flow chart depicting aspects of a method for estimating formation pore pressure and an associated uncertainty.

Reference may now be had to FIG. 3 which presents a flow chart depicting aspects of a method 20 for determining pore pressure and pore pressure uncertainty as a function of depth. Step 21 in method 20 calls for conveying a carrier coupled to the downhole tool 10 through a borehole. Step 22 calls for performing formation measurements using the downhole tool 10 to obtain a log of formation measurements related to pore pressure.

Step 23 calls for defining a first or upper depth interval and a second or lower depth interval that is deeper in the borehole than the upper depth interval. Each depth interval includes at least one formation measurement made within those intervals. Step 24 calls for establishing a plurality of compaction trendlines extending from the upper depth interval to the lower depth interval and beyond. Each trendline is defined by a unique set of measurement points with one measurement point being in the upper depth interval and one measurement point being in the lower depth interval. Each trendline may be parameterized by a slope and an intercept. While the trendlines may be linear, they may also follow a curved function such as exponential functions or polynomial functions. Alternatively, steps 23 and 24 may be performed with all data values coming from one single interval (e.g., the complete normal compaction zone).

Various ways may be employed to establish a plurality of trendlines. One way is to determine a set of points (i.e., one point in the upper depth interval and one point in the lower depth interval) that establishes a first trendline having a minimum slope and minimum intercept and a set of points that establishes a second trendline having a maximum slope and maximum intercept from all sets of points in the upper and lower depth intervals. The upper and lower depth intervals may be predefined or selected according to techniques disclosed in U.S. patent application Ser. No. 13/229,212, which is incorporated by reference in its entirety. Alternatively, the first trendline may be established having a minimum slope and maximum intercept and the second trendline may be established having a maximum slope and minimum intercept. In general, the combination providing the widest spread in values may be selected to provide the basis for representing the most likely associated uncertainty. Another way of establishing a plurality of trendlines involves generating trendlines through every combination or set of measurement points in the upper and lower depth intervals. Other techniques to establish the plurality of trendlines may be obtained from U.S. patent application Ser. No. 13/229,212.

The dependence of the attributes of the calculated normal compaction trendline on the log variability has been used to calculate a series of trendlines over different depth intervals by an algorithm described above. The normal compaction trendline may be calculated automatically or semi-automatically using a processor or may be manually entered into a processor. The series of trendlines can then be used to calculate an average normal compaction trendline and the uncertainty associated with the average trendline. Different definitions are proposed for the uncertainty. One definition (Method 1) is the standard deviation for the average slope and intercept of all the determined trendlines. Another definition (Method 2) is the maximum and minimum slope determined out of all determined trendlines.

Figure 4:
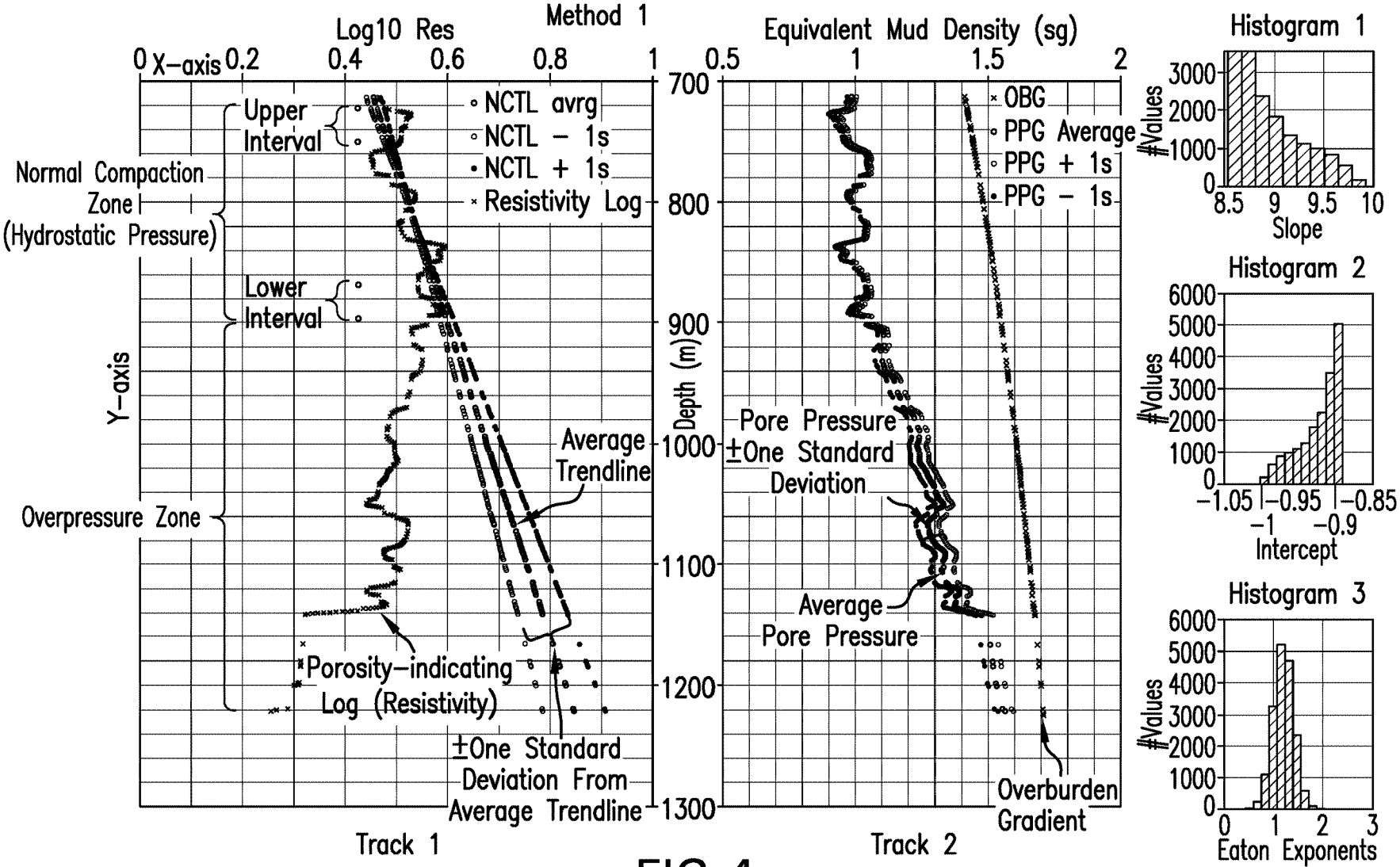
FIG. 4 depicts aspects of one approach for estimating formation pore pressure and an associated uncertainty.
Figure 5:
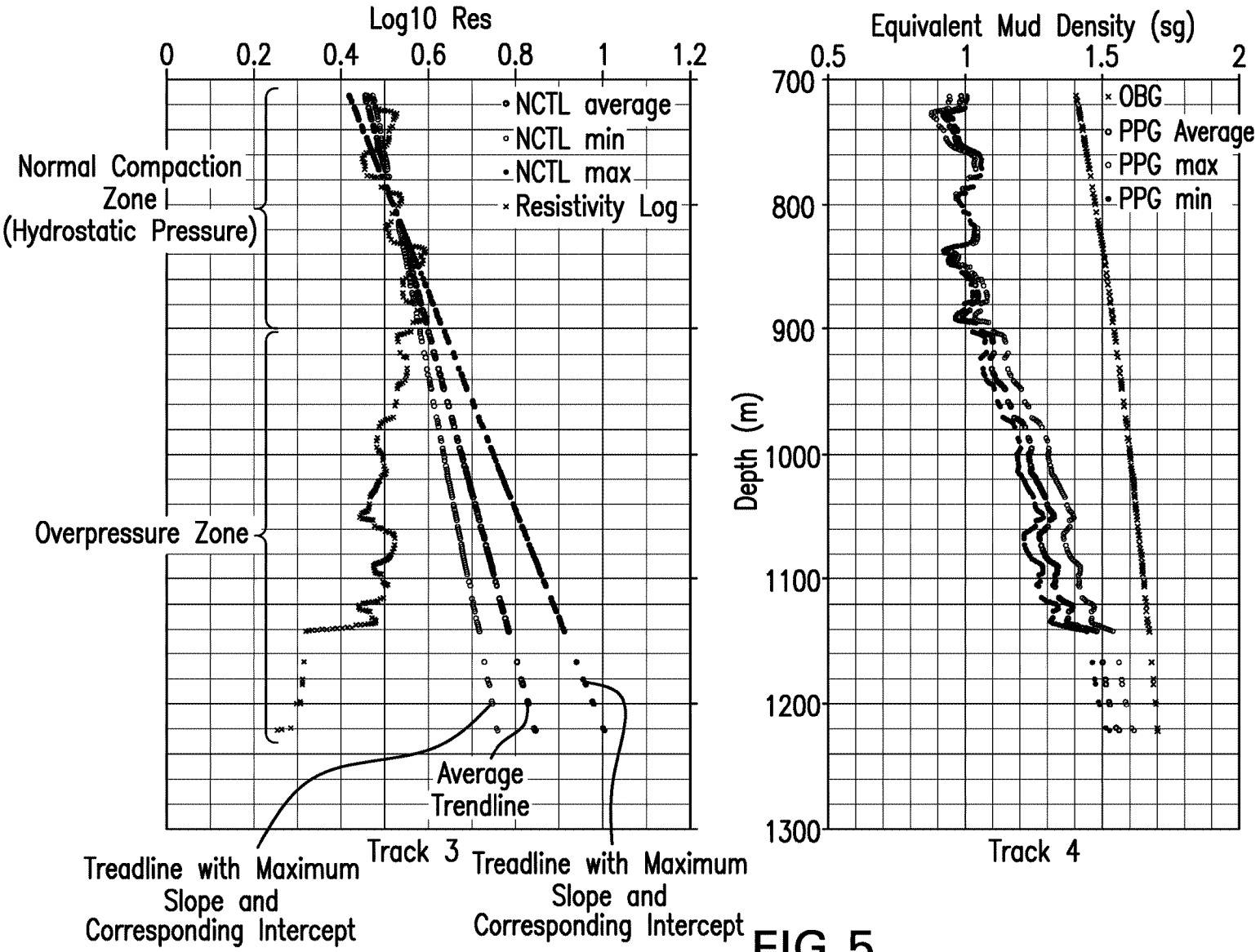
FIG. 5 depicts aspects of another approach for estimating formation pore pressure and an associated uncertainty.

Because there may be many trendlines, such as in the hundreds or even thousands, it may not be possible to illustrate all of them on one plot. In cases like this, one or more trendlines with associated uncertainty may be plotted as a representation of all the trendlines. Track 1 in FIG. 4 shows an example of a pore pressure related log, which is in this case a porosity-indicating resistivity log, overlain by an average normal compaction trendline. The trendline fits the porosity-indicating log in the normal compaction interval and starts deviating from the porosity-indicating log in the overpressure zone. The average trendline is bounded by trendlines signifying +/− one standard deviation (+/−1 s). FIG. 4 Track 1 was developed using Method 1. FIG. 5 Track 3 is an example of representing all the trendlines by plotting the maximum and minimum slope determined out of all the trendlines using Method 2. In FIGS. 4 and 5, the resistivity axis is logarithmically scaled, however, other scaling including linear scaling can be used as well.

Figure 6B:
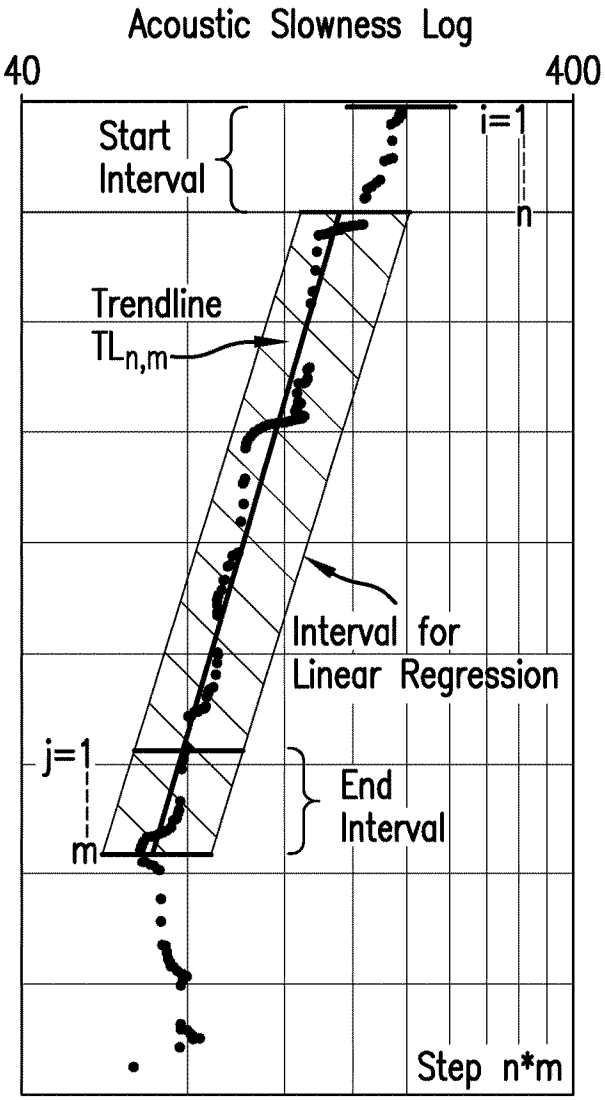
FIGS. 6A and 6B, collectively referred to as FIG. 6, depict aspects of nomenclature of an algorithm to calculate pore pressure uncertainty form variations of the normal compaction trendline as demonstrated on an acoustic log.
Figure 6A:
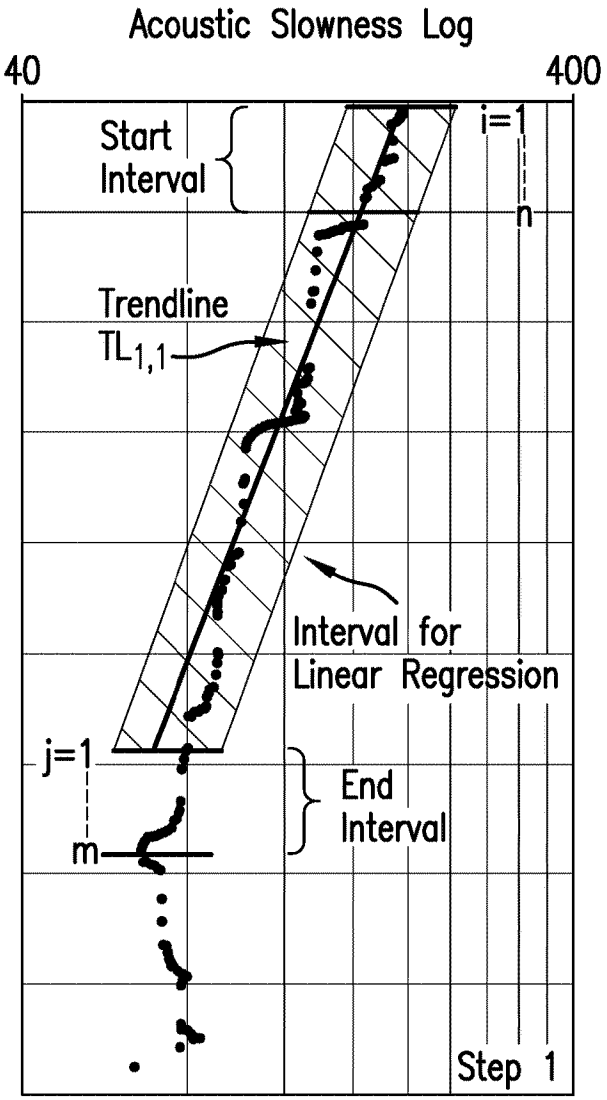

These two methods to define a representative trendline and a representative value for the variation of the trendlines will be explained in more detail. For both methods, two intervals need to be defined from which the series of trendlines are generated: a start interval containing i=1 . . . n data points and an end interval containing j=1 . . . m data points (see FIG. 6A for nomenclature). In one or more embodiments, both intervals reside in the normal compaction zone, although this is not required. As a first step, a regression analysis is performed over the interval beginning at the first data point from the start interval (i=1) and ending at the first data point from the end interval j=1), yielding the trendline $TL_{1,1}$. This trendline may be in the normal compaction zone although it does not have to be. Step n of the analysis defines the interval for linear regression from data point i=n to j=1, giving $TL_{n,1}$. The final linear regression analysis is performed for i=n, j=m to obtain trendline $TL_{n,m}$ (see Step n*m in 6B). This approach gives a series of n*m trendlines.

Histograms 1 and 2 in FIG. 4 illustrate the spread in slope values and intercept values (assuming linear regression which is not a requirement) of a series of trendlines as calculated according to the procedure explained above, respectively. By assuming more parameters in the trendline and defining more intervals, the same method may be applied resulting in trendlines with more curvature. The distribution of the parameters derived from the series of normal compaction trendlines may be further used as input for other pore pressure uncertainty calculating approaches. These approaches may include for example error propagation laws, simulations, and neural networks. For example, Monte Carlo Simulations use a parameter distribution as input assigned to the modeling parameters. In Monte-Carlo simulation applied to pore pressure modeling, the modeling approach is first defined such as using one of Equations (1)-(6). Using Equation (1) as an example, input data/parameters used to calculate the pore pressure are the overburden gradient (OBG), the resistivity log $R_0$, the hydrostatic pore pressure PPN and the "normal resistivity value" $R_N$, which is the resistivity corresponding to the normal compaction trendline. The resistivity log $R_0$ is determined from actual resistivity measurements. Deviations of $R_0$ from $R_N$ may result from an overpressure condition. For a Monte-Carlo Simulation, each of these input parameters is not an exact value but represented by a probability distribution. For example, OBG may range from 12-14 ppg with its most likely value at 13 ppg. Likewise, the normal compaction trendline is not a straight line (defined by its slope and intercept) anymore, but a series of trendlines defined by a probability distribution of slopes and intercepts. Then, in Monte Carlo Simulation the necessary input data are randomly selected (with values within the distribution or parameter range) and a pore pressure model is calculated. This procedure is repeated a large number of times (for example 10000 times or more) so that a series of pore pressure models is created with a certain probability distribution. Hence, the distribution of slopes and intercepts described above may be used as input for a Monte-Carlo simulation.

Step 25 in method 20 calls for calculating a pore pressure line (i.e., a representative, c.f. most likely estimate of pore pressure as a function of depth) and associated uncertainty using the plurality of trendlines. Various methods are known in the art for converting porosity to pore pressure. One method is referred to as Eaton's method. Eaton's method can be used with resistivity logs, conductivity logs, acoustic velocity logs, acoustic slowness logs, or drilling exponent data. Equations (1)-(5) list various forms of equations in Eaton's method for calculating pore pressure (PP) depending on the type of log used to measure porosity. Eaton's method uses the overburden gradient as an input to the method. The overburden gradient is determined using established techniques (e.g., integration of density logs) and is shown in Track 2 in FIG. 4 and Track 4 in FIG. 5.

$$PP = OBG - (OBG - PP_N)\left(\frac{R_0}{R_N}\right)^x \tag{1}$$

$$PP = OBG - (OBG - PP_N)\left(\frac{V_0}{V_N}\right)^x \tag{2}$$

-continued $$PP = OBG - (OBG - PP_N)\left(\frac{DT_N}{DT_0}\right)^x \tag{3}$$

$$PP = OBG - (OBG - PP_N)\left(\frac{C_N}{C_O}\right)^x \tag{4}$$

$$PP = OBG - (OBG - PP_N)\left(\frac{DXC_0}{DXC_N}\right)^x \tag{5}$$

In the above equations:

Default value of Eaton exponent x in equation (1) is 1.2;

Default value of Eaton exponent x in equations (2) and (3) is 3;

OBG=overburden gradient (ppg, kPa/m, or g/cm$^3$);

$PP_N$=normal (i.e., hydrostatic conditions) pore pressure gradient (ppg, kPa/m, or g/cm$^3$);

$R_0$=observed resistivity (Ωm);

$R_N$="normal" (expected) resistivity (Ωm);

$V_0$=observed interval seismic or acoustic velocity (m/s or ft/s);

$V_N$="normal" (expected) interval seismic or acoustic velocity (m/s or ft/s);

$DT_0$=observed transit time (μs/ft);

$DT_N$="normal" (expected) transit time (μs/ft);

$C_0$=observed conductivity (S/m);

$C_N$="normal" (expected) conductivity (S/m);

$DXC_0$=observed DXC; and $DXC_N$="normal" (expected) DXC where "normal" means the value taken from the normal compaction trendline.

As with establishing the plurality of trendlines, there are a number of ways to determine the pore pressure line, which represents pore pressure as a function of depth, and an associated uncertainty. In one way illustrated in Track 3 in FIG. 5, a representative trendline is calculated from the first trendline having the minimum slope and the second trendline having a maximum slope. The representative trendline can be an average of the two trendlines in one embodiment. It can be appreciated that other mathematical techniques can be used to determine the representative trendline such as calculating a mean trendline. The uncertainty associated with the average trendline is the spread between the first trendline and the second trendline.

Once the representative trendline is calculated, Eaton's method can be applied to determine the pore pressure gradient log (i.e., the representative pore pressure gradient log). Similarly, Eaton's method can be applied to the first trendline and the second trendline to determine the spread of values or uncertainty about the pore pressure gradient log. Other methods may also be used to determine the representative pore pressure gradient log such as Gaussian error propagation and using only the upper and lower limits calculated by Eaton's method while representative trendline is the average of the upper and lower limits. Further, methods disclosed in U.S. application Ser. No. 13/229,212 may be used to determine the spread of uncertainty about the pore pressure gradient log.

An alternative method for calculating the pore pressure is the equivalent depth method which also uses the normal compaction trendline as an input parameter. The method assumes that every depth point in an overpressured shale interval has a corresponding (equivalent) point in the normally compacted interval above on the normal compaction trend line. Both points have the same porosity (as indicated by an identical resistivity, acoustic, or drilling exponent value) and thus yield the same effective stress. Knowing the overburden and hydrostatic gradient, pore pressure can be determined as given by:

$$PP = \frac{PP_N \cdot D_1 + (OBG_2 \cdot D_2 - OBG_1 \cdot D_1)}{D_2} \quad (6)$$

With $D_1$ and $D_2$ being the upper and lower depth, respectively, and $OBG_1$ and $OBG_2$ the overburden gradient at the respective depth points.

When the plurality of trendlines involves generating trendlines through every combination of measurement points in the upper and lower depth intervals, two approaches may be used to determine the pore pressure line and associated uncertainty. In the first approach, Eaton's method using constant parameters is applied to each trendline in the plurality of trendlines to generate a plurality of corresponding pore pressure lines. The representative pore pressure line, such as an average pore pressure line for example, is then calculated from the plurality of pore pressure lines. A statistical method is then applied to the plurality of pore pressure lines to calculate the standard deviation of the plurality of pore pressure lines. The standard deviation is one example of the uncertainty associated with the representative or calculated pore pressure line.

In the second approach, Eaton's method using a random varying parameter such as Eaton's exponent is applied to each trendline in the plurality of trendlines to generate a plurality of corresponding pore pressure lines. As in the first approach, the pore pressure line can be calculated as an average of the plurality of corresponding pore pressure lines. Similarly, a statistical method is then applied to the plurality of pore pressure lines to calculate the standard deviation of the plurality of pore pressure lines where the standard deviation represents the uncertainty. This approach is illustrated in Tracks 1 and 2 in FIG. 4 with Histogram 3 illustrating the distribution of the Eaton exponents.

It can be appreciated that certain mathematical techniques other than calculating an average may be used to determine the calculated pore pressure line. In one or more embodiments, a mean value may be calculated. It can also be appreciated that certain statistical techniques other than calculating the standard deviation may be used to calculate the uncertainty associated with the calculated the pore pressure line.

It can be appreciated that as the borehole 2 is drilled deeper into the earth 3 in a real time LWD application the second depth interval can be continuously shifted deeper into the earth 3 or widened so that the lower part of the interval extends deeper into the borehole 2. In addition, the first depth interval may also be shifted or widened deeper into the borehole 2. As the depth intervals are shifted or widened, these new intervals are continuously populated with formation measurements performed within these intervals. In one or more embodiments, the second depth interval maintains a constant length and is continuously shifted to be at the deepest point of the drilling run up to where the normal compaction trend ends. In one or more embodiments, the depth intervals are changed with drilling such as to maintain a predefined ratio of the lengths of the depth intervals to the total drilling depth (e.g., the lengths of the depth intervals are maintained at 0.1 times the total drilling depth). In one or more embodiments, the upper depth interval and the upper point of the lower depth interval remain fixed while the lower point of the lower depth interval is continuously moved deeper in the borehole. It can be appreciated that there are many approaches to shift or widen the depth intervals either continuously as the borehole is being drilled or at certain time or drilling distance intervals and that these additional approaches are inherently included in this disclosure.

It can be appreciated that as the depth intervals are shifted or widened, the steps of the method 20 are iterated to provide a latest estimate of the pore pressure line and the associated uncertainty.

It can be appreciated that the method 20 can be performed using more than one pore pressure related log and that a combined statistical analysis can be performed on all pluralities of trendlines established from each log. In addition, the pore pressure line (e.g., the average pore pressure line) and its associated uncertainty can be calculated from these pluralities of trendlines.

It can be appreciated that trendlines can be established by linear regression of all measurement points in the upper and lower depth intervals in lieu of a selection of only one measurement point in each interval to establish a trendline. As the depth intervals are shifted or widened and more formation measurement points are obtained, a plurality of trendlines are established and used to determine the pore pressure line and the associated uncertainty.

It can be appreciated that the pore pressure related logs for the use in the method 20 can be obtained from boreholes different from the borehole being drilled (e.g., offset boreholes or wells). In real time LWD applications, the analysis of trendlines can be performed on pore pressure related logs from offset wells, for instance on porosity-indicating logs from the target borehole being drilled. If the pore pressure related logs originate from different locations, a weighting function may be applied to the derived trendlines in order to represent the transferability of characteristics between the locations of the boreholes wherein the logs were acquired.

In one or more embodiments, the method 20 can include a step for identifying the presence of shale such as with a gamma-ray log for example and for filtering out those pore pressure related measurements performed on non-shale portions of the formation.

Disclosed next is a method for estimating pore pressure uncertainty in the overpressure region of an earth formation from the uncertainty observed in the normal compaction interval above the overpressure region. Already while drilling in a still normally pressured subsurface formation, the method is able to estimate the order of magnitude of the uncertainty associated with the pore pressure model in the overpressure region using data obtained while drilling in a still normally pressured subsurface formation. Drilling operational procedures, such as determining a pressure window for drilling, can be developed according to this estimation.

The disclosed method uses a series of normal compaction trendlines, calculated as described above, and calculates a "trendline envelope" as the upper and lower bounds within which the series of trendlines vary. Different methods can be used to define different trendline envelopes. Irrespective of the applied method for envelope definition, the trendline envelope shows a continuous increase in trendline uncertainty with depth in the overpressure zone. This increase is quantified by calculating the depth-based derivative of the difference between the two trendline bounds as a measure of the change in trendline envelope with depth. Whereas this quantity has exclusively been derived from data in the normal compaction zone, an empirical correlation between this quantity and the magnitude of the pore pressure uncertainty in the overpressure (undercompacted) region was observed from different data sets from Gulf of Mexico, Asia Pacific and North Sea basins.

Two different methods are introduced here to derive the uncertainty of the pore pressure model as a result of variations in the normal compaction trendline: a statistical and a geometrical approach. The statistical approach calculates one pore pressure model using any of Equations (1) through (6), for example, for each trendline of the series that has been calculated by the linear regression, which likewise results in a series of n*m pore pressure models. This series is then statistically analyzed to derive an average pore pressure model and its standard deviation (±one sigma, see FIG. 4). Of course, a statistically sound result requires a sufficient amount of trendlines and pore pressure models in the series. This is achieved by setting the start and end intervals for linear regression in a way that a sufficient amount of data points reside in either of the two intervals, yielding a sufficient amount of trendlines and models. For example, at least 50 data points may need to reside in either of the two intervals, yielding more than 2500 trendlines and models.

The second proposed method extracts the two normal compaction trendlines exhibiting the largest and smallest slopes, respectively, out of the series of trendlines. These two trendlines are then used to calculate the pore pressure models by using, for example, any of Equations (1) through (6).

Figure 7A:
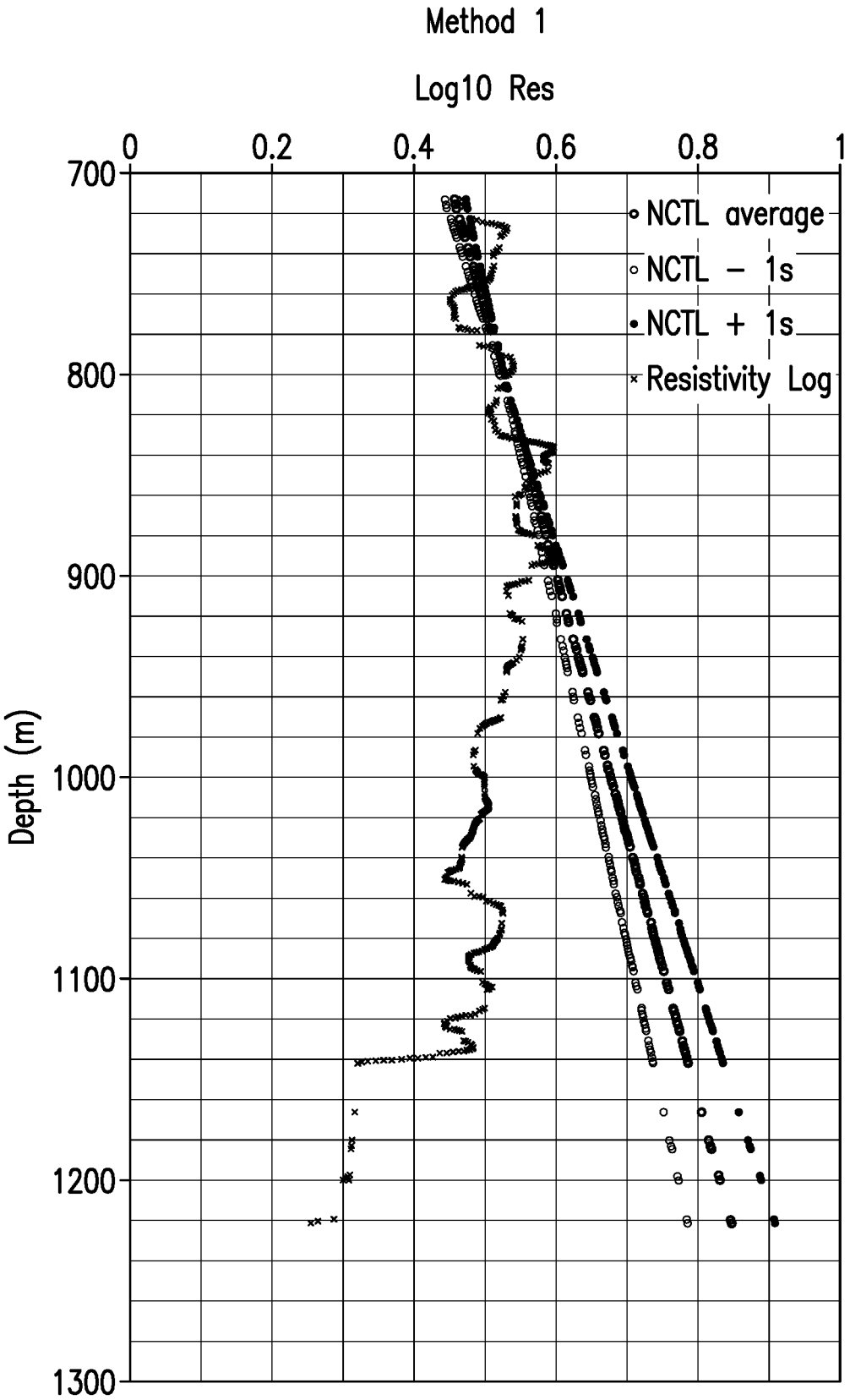
FIGS. 7A, 7B, and 7C, collectively referred to as FIG. 7, depict aspects of first and second methods for establishing uncertainty trendlines.
Figure 7B:
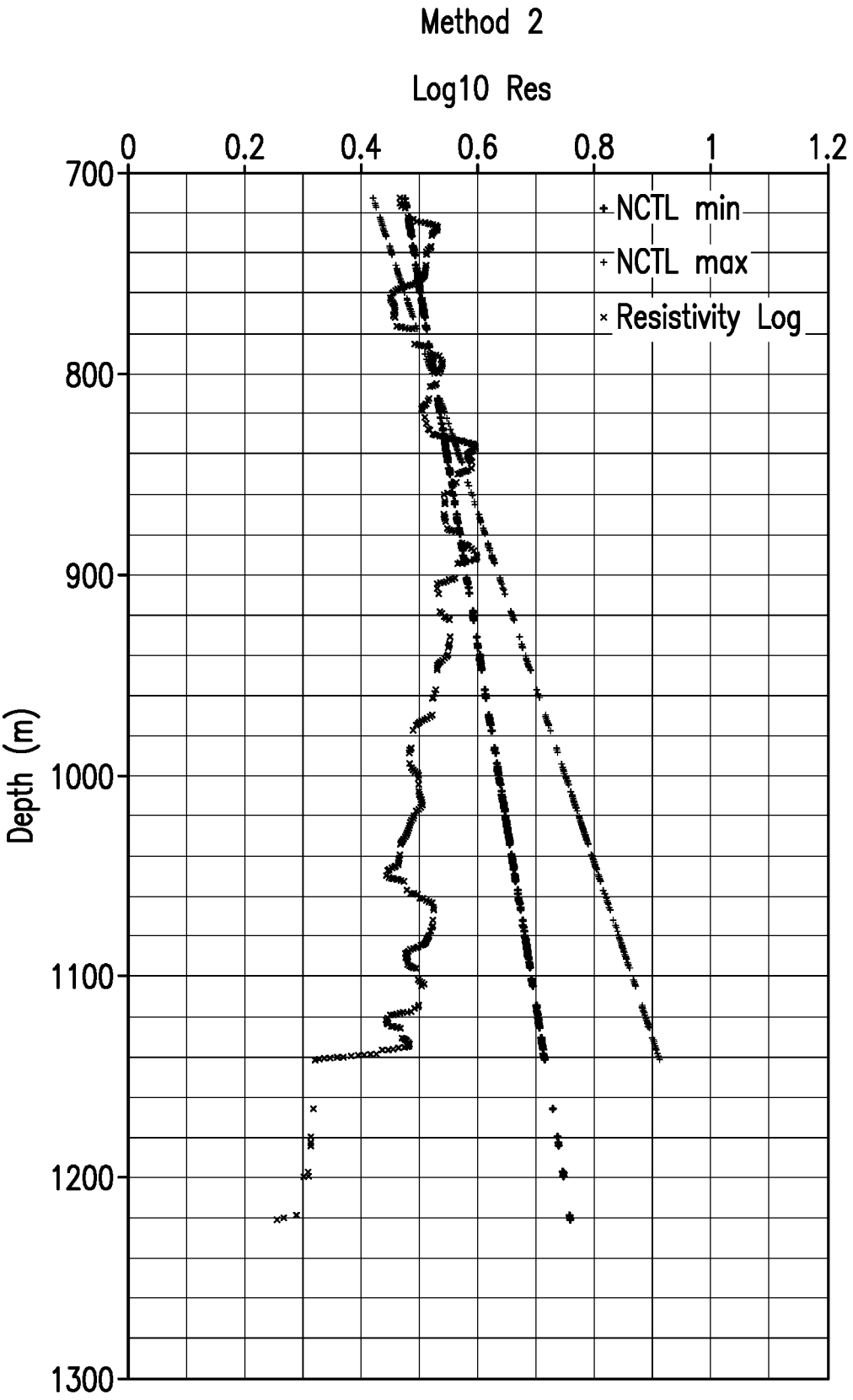

An example for the trendline envelopes is shown in FIG. 7. The track in FIG. 7A shows a logarithmically scaled resistivity log, an average normal compaction trendline (NCTL) and the NCTL's ±1 standard deviation. In this example, the normal compaction interval ends at around 900 meter. Note that the NCTL's do not cross each other at ~800 meter, hence only the average normal compaction trendline is a straight line on a semi-logarithmic scale. The difference between the two enveloping trendlines (NCTL±1 sigma) becomes larger with increasing depth, in particular in the overpressure region below 900 meter. The track in FIG. 7B shows the two extreme normal compaction trendlines with the maximum and minimum slopes, respectively. These two NCTL's cross each other at ~800 meter and behave linearly on the log 10 resistivity scale. Also the difference between these two enveloping trendlines becomes larger with increasing depth.

A quantification parameter or "Q factor" is defined describing the increasing difference between the enveloping normal compaction trendlines:

$$Q := \frac{d}{dz}(\Delta R_N^*), \tag{7}$$

where d/dz is the derivative of $\Delta R_N^*$ with depth z, and $$\Delta R_N^* = \log_{10} R_N^u - \log_{10} R_N^l \tag{8}$$

describes the difference of the upper ($R_N^u$) and lower ($R_N^l$) bounds of the normal compaction trendlines. Of course, Q can be defined also for calculating the uncertainty propagation derived from acoustic slowness data or other pore pressure related logs. The Q factor is thus a measure of how the normal compaction trendline envelopes will change with depth, and how this change will affect the uncertainty associated with pore pressure. The Q factor can be used to compare the uncertainty resulting from different pore pressure related logs (such as acoustic logs and resistivity logs) within one well, and the Q factor can also be used to compare the uncertainty resulting from the same pore pressure related logs between different wells.

Figure 7C:
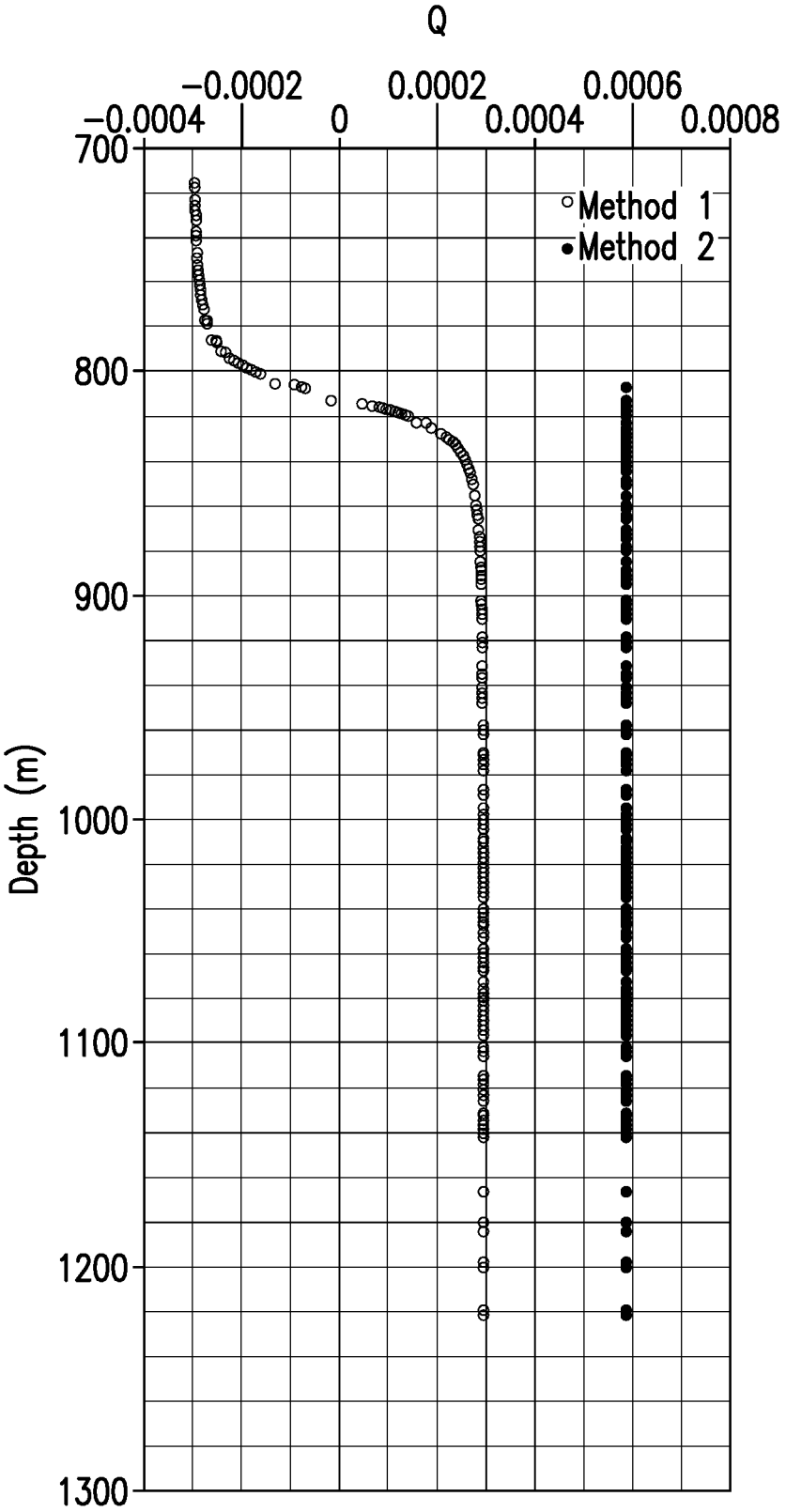

For the example data set presented in FIGS. 7A and 7B, the Q factor is shown in FIG. 7C for methods 1 and 2. For method 1, the Q factor begins with a negative sign, continually increases and finally approaches a constant value of 0.0003/m at greater depth. This asymptotic behavior allows the specification of one value that is characteristic for the opening behavior of the trendline envelopes, and the asymptotic behavior has been observed on all test data sets that were available for the present investigation. Therefore, a q factor is disclosed:

$$q := Q \text{ where } Q(z) = \text{constant value.} \tag{9}$$

For method 2, the Q factor is constant for all depth, because the trendline envelope is bound by two straight lines; hence the change in the difference between these two is constant.

Figure 8:
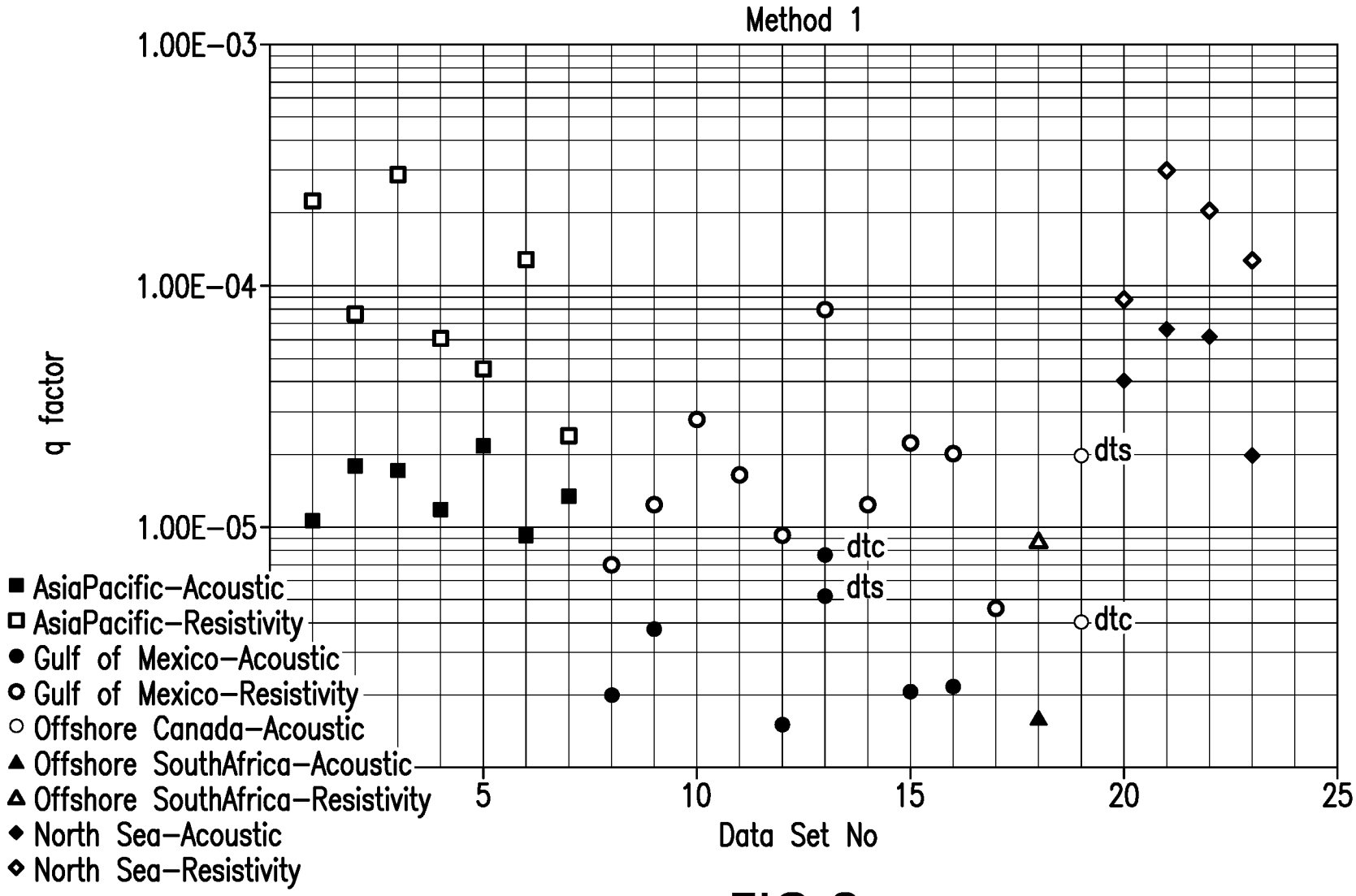
FIG. 8 depicts aspects of q-factor derived from the increasing difference between the maximum and minimum uncertainty trendlines developed from the first method for resistivity and acoustic data from various regions throughout the world.
Figure 9:
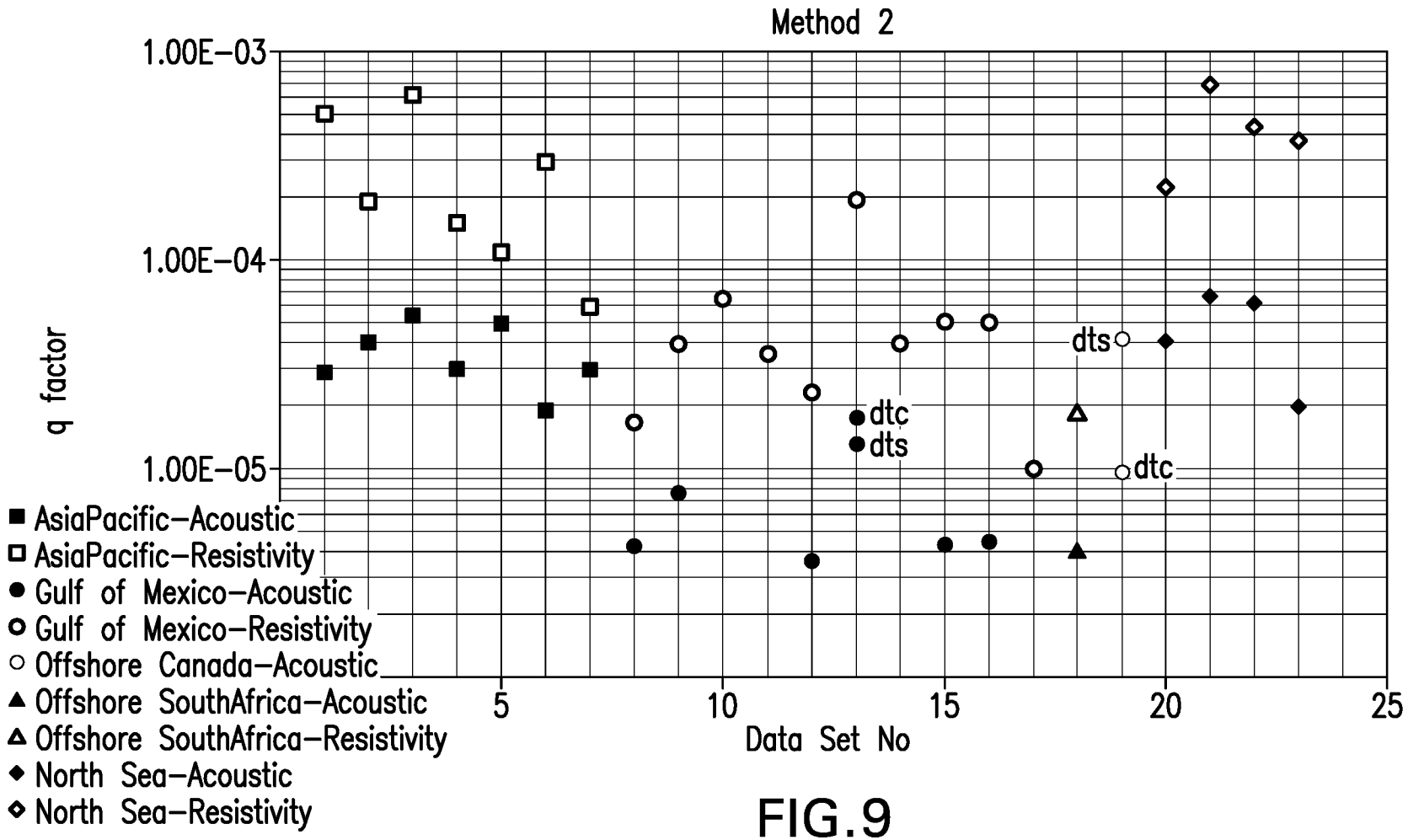
FIG. 9 depicts aspects of q-factor derived from the increasing difference between the maximum and minimum uncertainty trendlines developed from the second method for resistivity and acoustic data from various regions throughout the world.

The q factor is expected to be different for resistivity and acoustic logs because acoustic logs generally show less variability/curvature. A study of the q factor behavior was performed on data sets from different world wide regions such as Asia Pacific, Gulf of Mexico, North Sea, Offshore Canada and Offshore South America as shown in FIGS. 8 and 9. In general, the q factor from resistivity data proved to be larger compared to the q factor from acoustic data, and the resistivity q factor is also more scattered. As also expected, the q factor from method 2 is larger (FIG. 9) compared to method 1 (FIG. 8).

For locations where multiple wells were available, a comparison of the q factor shows that data from the Gulf of Mexico exhibit the lowest q factor magnitudes, Asia Pacific data sets exhibit intermediate, and North Sea data exhibit the highest q factors. This observation implies that the analysis of normal compaction trendline and pore pressure uncertainties should be performed on data sets from the same geological basin.

A series of pore pressure curves $PP_i$ can also be calculated from the series of normal compaction trendlines $R_N^i$, applying Eaton's equation, which is rewritten here for convenience as Equation (10):

$$PP_i = OBG - (OBG - PP_N)\left(\frac{R_0}{R_N^i}\right)^x, \tag{10}$$

where OBG is the overburden gradient (or lithostatic pressure), $PP_N$ is the hydrostatic pore pressure under normal conditions (in the normal compaction zone), $R_o$ is the measured resistivity and x is the Eaton exponent. A similar equation exists for acoustic logs or other pressure related logs (see Equations (2)-(6) for example). The series of pore pressure curves can then be used to determine an average pore pressure and associated uncertainties such as ±1 standard deviation. For the calculated normal compaction trendline envelopes from FIG. 7, an example for the calculated pore pressure uncertainty is given in FIGS. 4 and 5 for methods 1 and 2, respectively.

The pore pressure uncertainty $U_{PP}$ is a nonlinear function of the trendline envelopes, as determined from inserting the upper and lower bound of normal compaction trendlines, $R_N^u$ and $R_N^l$, into Eaton's Equation (10):

$$U_{PP} = PP(R_N^u) - PP(R_N^l) = (OBG - PP_N)R_0^x \frac{(R_N^l)^x - (R_N^u)^x}{(R_N^u \cdot R_N^l)^x} \tag{11}$$

Accordingly, similar expressions can be derived from equations (2)-(6). The pore pressure uncertainty can thus be calculated while drilling in the overpressure region and once porosity-indicating or other pore pressure related logs ($R_0$ in this case) are available.

A prediction of $U_{PP}$ from the q factor was found to be possible by correlating $U_{PP}$ with the q factor for acoustic data or for resistivity data. $U_{PP}$ was calculated using Eq. (10) for the overpressure zone, and then depth-averaging PP and $U_{PP}$ to obtain one representative value for the pore pressure and its uncertainty within the overpressure zone. Division of $U_{PP}$ by PP gives the relative depth-averaged pore pressure uncertainty $U_{ref}$(PP).

The pore pressure uncertainty may be calculated as the depth-averaged uncertainty of pore pressure uncertainties within the overpressure zone as in Equation (12).

$$U_{abs}(PP)=\overline{PP(R_N^u)-PP(R_N^l)} \tag{12}$$

Equation (12) may then be used to calculate the relative depth-based pore pressure uncertainty as in Equation (13) with $\overline{PP}$ being the depth-averaged pore pressure.

$$U_{rel}(PP) = \frac{U_{abs}(PP)}{\overline{PP}} \tag{13}$$

Figure 10:
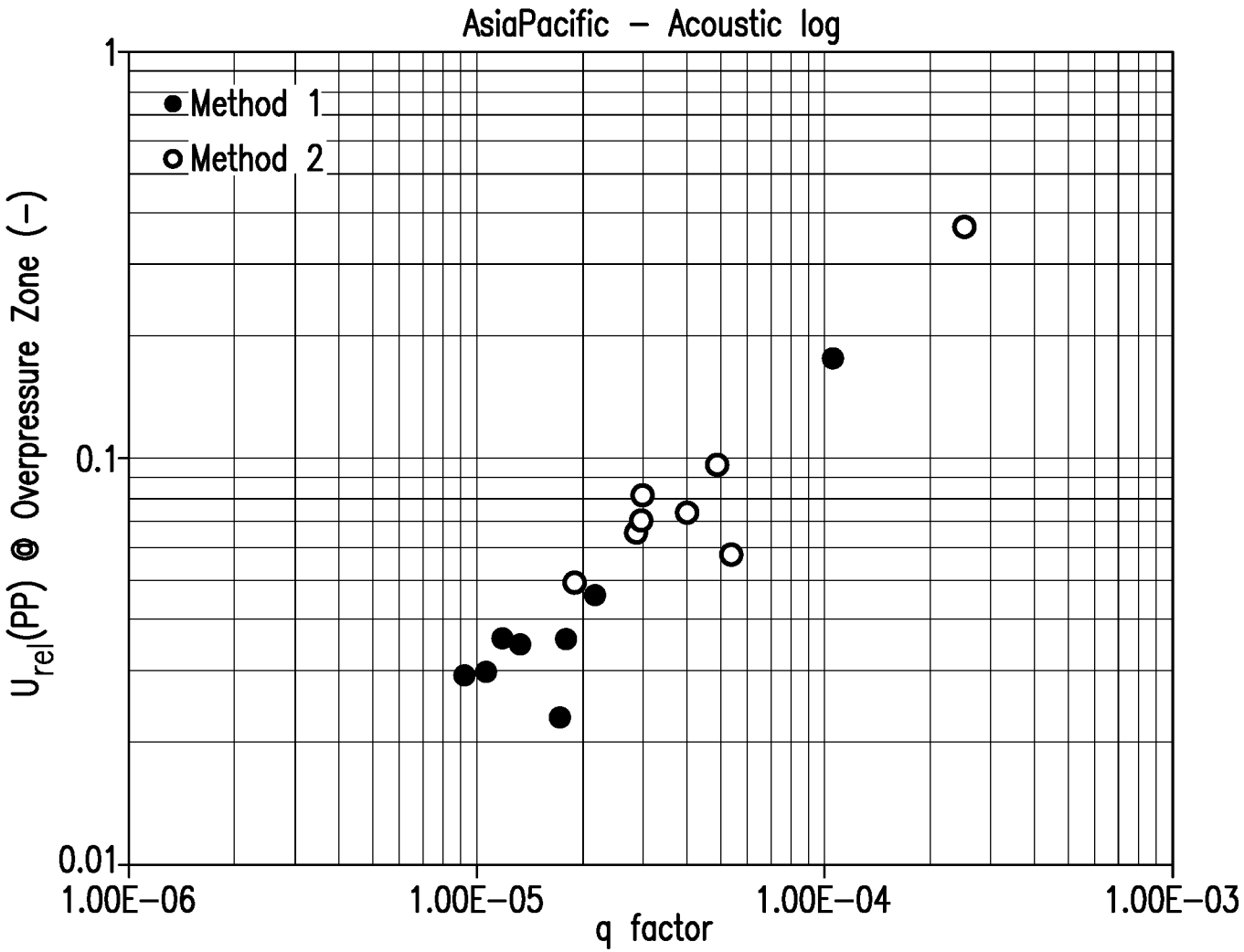
FIG. 10 depicts aspects of pore pressure uncertainty versus q-factor for acoustic log data obtained from the Asia-Pacific region.
Figure 11:
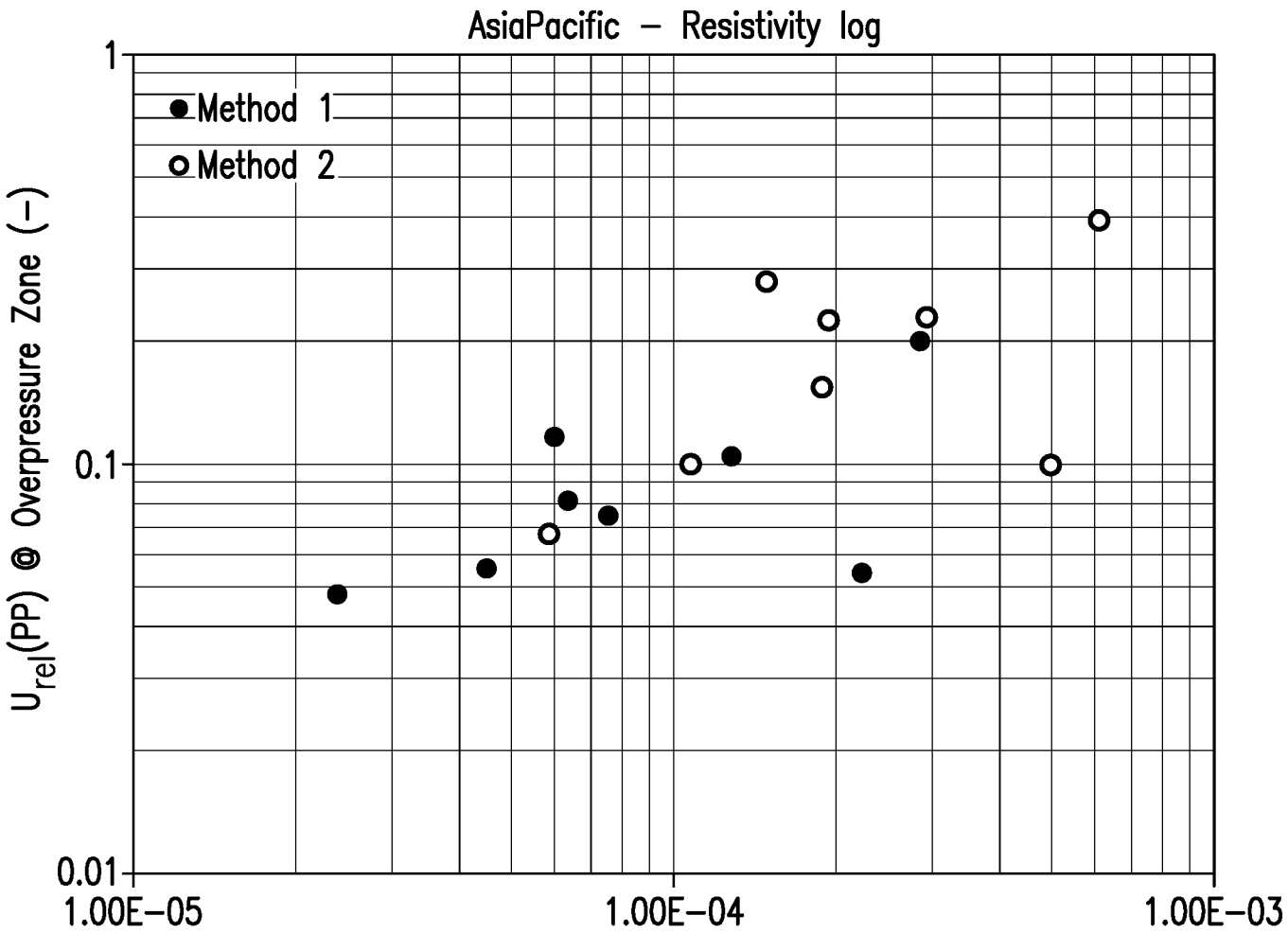
FIG. 11 depicts aspects of pore pressure uncertainty versus q-factor for resistivity log data obtained from the Asia-Pacific region.

The correlation between q and $U_{ref}$(PP) was conducted on the three multi-well data sets from the Asia Pacific region, the Gulf of Mexico, and the North Sea, both on acoustic and resistivity logs, respectively. For the data from the Asia Pacific region, FIGS. 10 and 11 show the correlations for acoustic and resistivity logs derived for methods 1 and 2. The acoustic data (FIG. 10) clearly show a correlation between $U_{PP}$ and q: larger q factors denote higher pore pressure uncertainty in the overpressure zone. This correlation is also evident in the resistivity data of FIG. 11.

Figure 12:
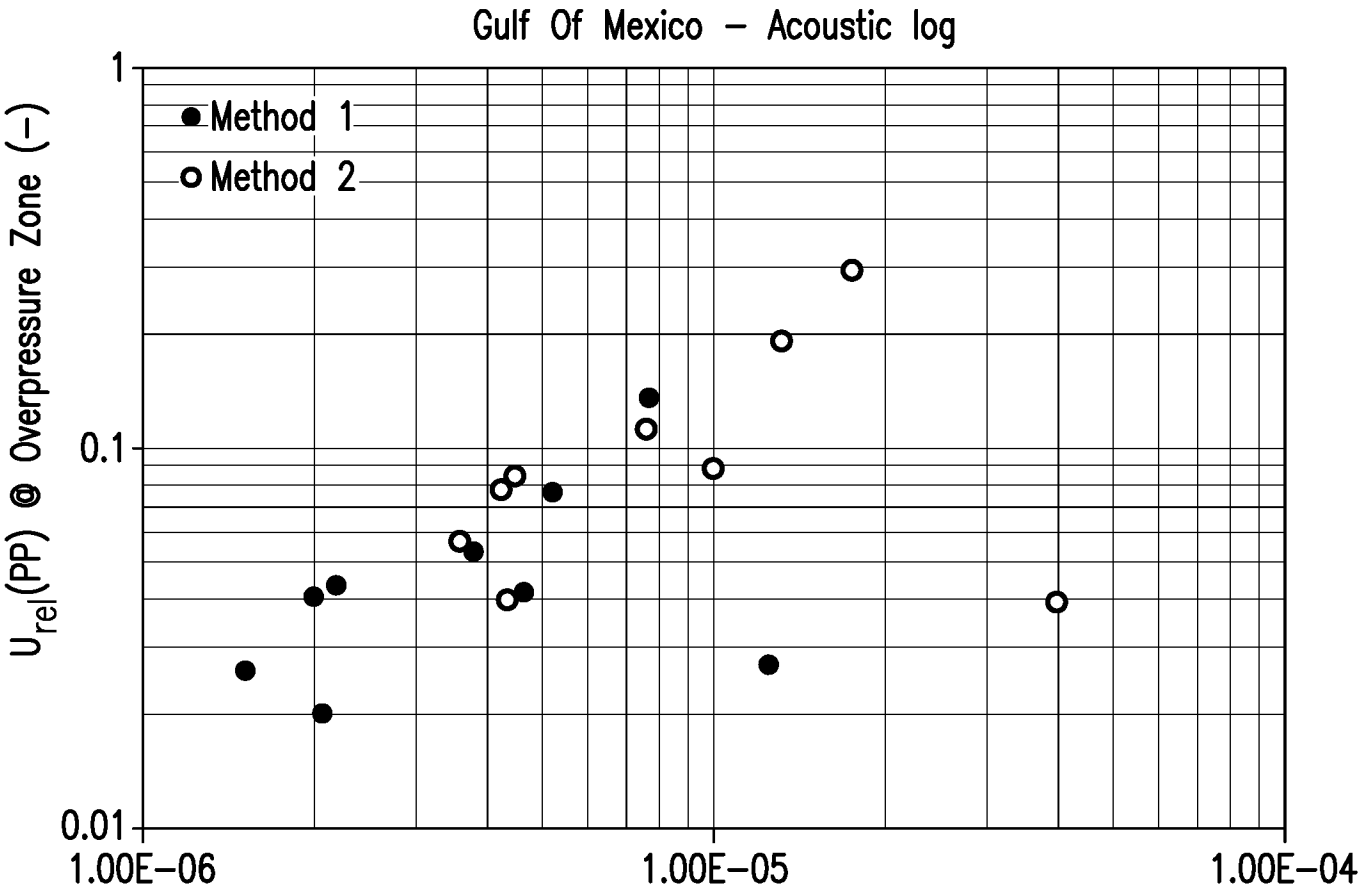
FIG. 12 depicts aspects of pore pressure uncertainty versus q-factor for acoustic log data obtained from the Gulf of Mexico region.
Figure 13:
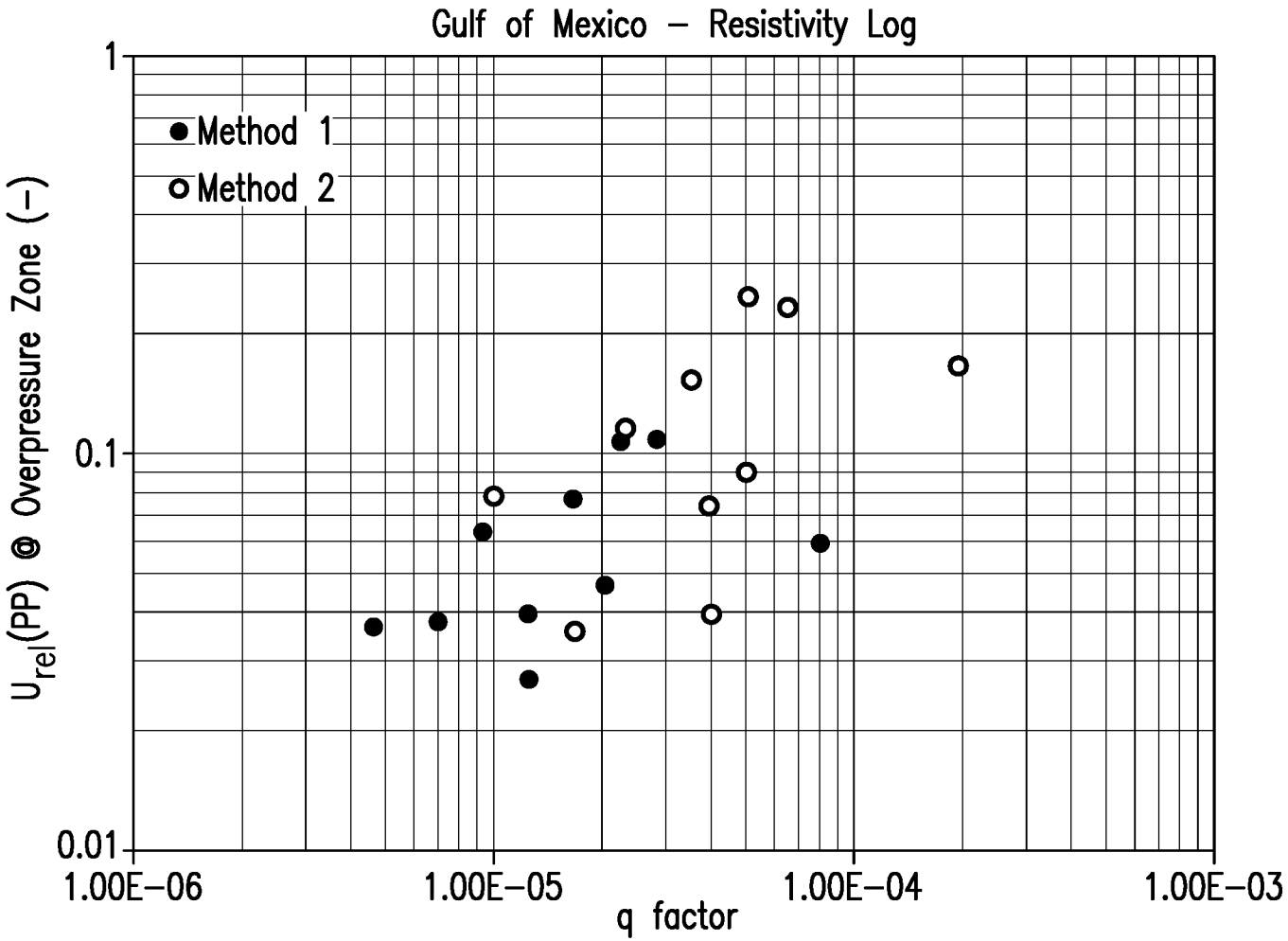
FIG. 13 depicts aspects of pore pressure uncertainty versus q-factor for resistivity log data obtained from the Gulf of Mexico region.
Figure 14:
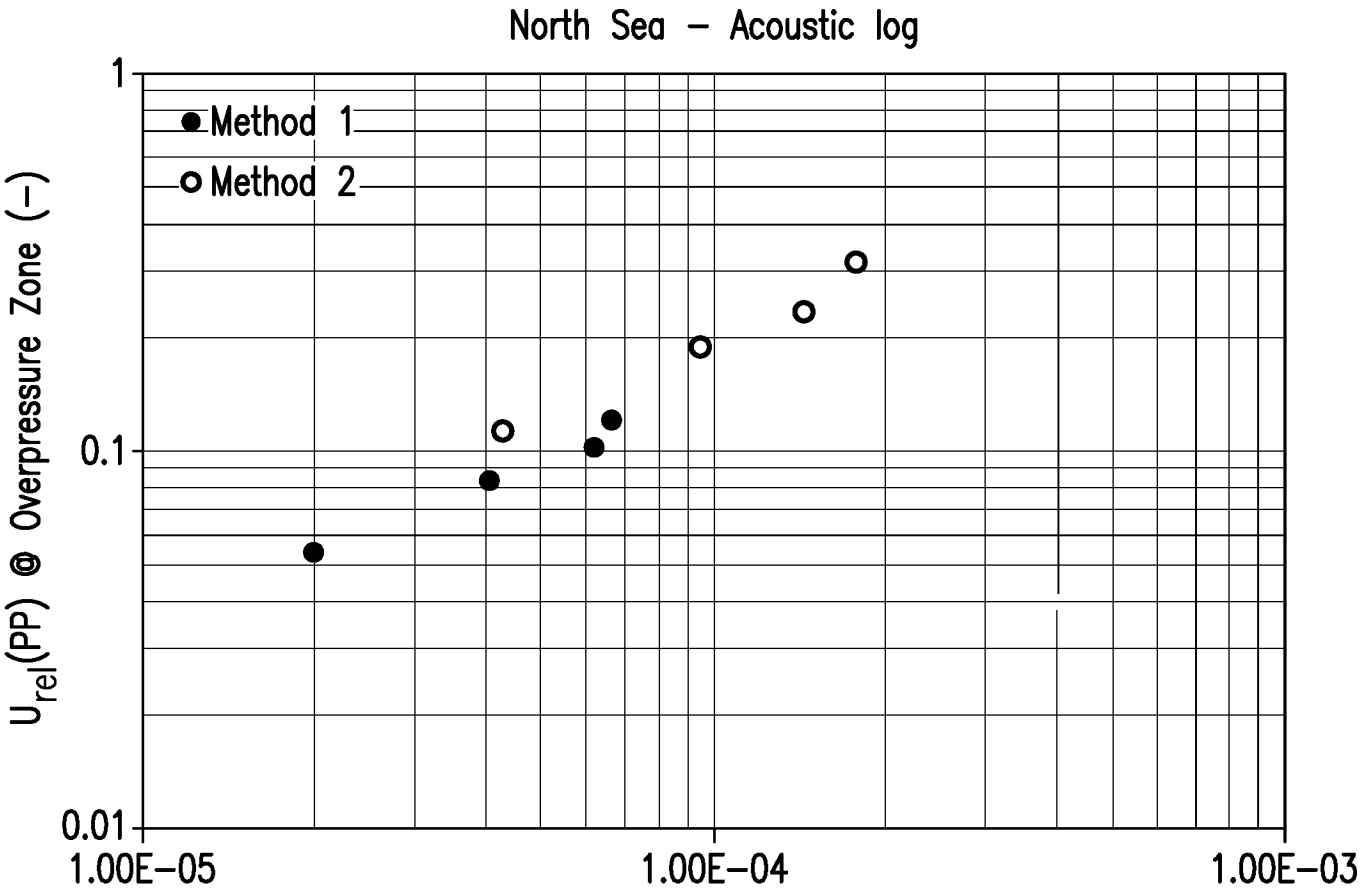
FIG. 14 depicts aspects of pore pressure uncertainty versus q-factor for resistivity log data obtained from the North Sea region.

A similar observation is made on acoustic data (FIG. 12) and resistivity data (FIG. 13) from the Gulf of Mexico. Finally, the acoustic data from the North Sea (FIG. 14) show a very clear correlation between the uncertainty and the q factor.

Potential reasons for a poor correlation between the q factor and the pore pressure uncertainty are inadequately processed data (no environmental corrections applied to resistivity logs), short normally compacted intervals for automatic analysis, geological circumstances (such as shallow water flows, structural features, salt) which complicate the interpretation of porosity-indicating or other pore pressure related logs, and improper application of the automation algorithm. The latter one requires some experience of the users of the algorithms. For example, a sufficiently large section of the normal compaction zone should be covered by the start and end intervals to incorporate geometric variances in the log (for further calculations). In addition, the number of data points in the intervals must be sufficient to ensure a statistically relevant number of trendlines.

The disclosed method is thus applicable for data from similar wells at least within one region (such as the Gulf of Mexico) and requires a sufficiently large number of drilled wells so that the correlation between the q factor and $U_{PP}$ can be derived. The method can then be applied to newly drilled wells by calculating the q factor and comparing the q factor against the q factors from the existing wells.

A highly beneficial feature of a real-time wellbore stability model is to predict the uncertainty associated with a pore pressure model in the overpressure zone by parameters acquired still in the normally compacted zone, which this disclosure covers in detail. If a sufficient amount of wells has been drilled in a specific region so that a correlation between the pore pressure uncertainty and the q factor can be derived, then a real-time (while drilling) application as illustrated by the flow chart in FIG. 15 may be implemented.

While drilling through the normal compaction zone and running a real-time pore pressure model (i.e., modeling pore pressure during the drilling operation on real-time streaming porosity-indicating or other pore pressure related logs and other relevant data), the onset of the overpressure zone is monitored. Once reaching the overpressure zone, the Q or q factor can be calculated and an expected uncertainty associated with the pore pressure model in the overpressure zone can be predicted. Also the uncertainty of the entire pressure window (fracture gradient, collapse gradient which both use the pore pressure gradient as input parameter) caused by pore pressure uncertainty can be estimated and an operating margin be defined around the pressure window bounds. This estimation of the operating margin is beneficial because the calculation of pore pressure uncertainty is based on formation evaluation sensors some meters behind the bit in addition to the accuracy of the sensors. Further, the operating margin can take into account the accuracy of equipment (such a pumps and valves) required to establish a desired drilling fluid or mud flow rate for dynamic pressure reasons, which can affect the downhole borehole pressure at the drill bit. Finally, the drilling conditions such as the mud weight and flow rate can be set to fit within the operating margins, and drilling into the overpressure zone can continue.

Figure 15:
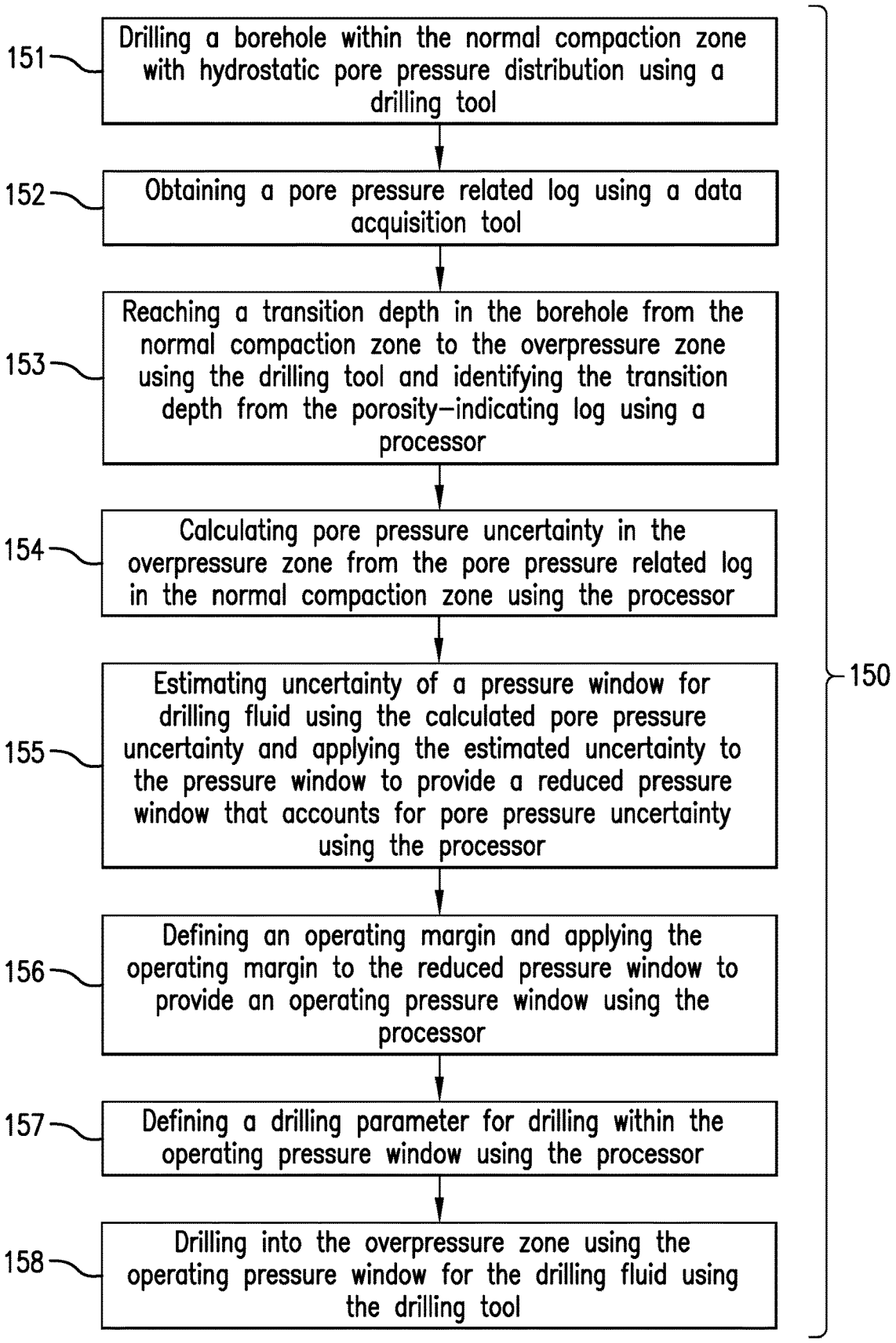
FIG. 15 is a flow chart for a method for determining a pressure window for drilling a borehole.

FIG. 15 is a flow chart for an exemplary method 150 for drilling a borehole in an earth formation having a normal compaction zone and an overpressure zone below the normal compaction zone. Included in the method 150 is a method for predicting a pressure window for drilling the borehole. Block 151 calls for drilling the borehole within the normal compaction zone with hydrostatic pore pressure distribution using a drilling tool. The drilling tool may include a drill tubular and any cutting tool such as a drill bit. Block 152 calls for obtaining a pore pressure related log using a data acquisition tool, which may be a downhole tool or a surface tool such as a seismic data acquisition tool. The downhole tool may include at least one of resistivity tool, a dielectric permittivity tool, a density tool, a neutron porosity tool, a pulsed neutron tool, a nuclear magnetic resonance tool, and an acoustic tool in non-limiting embodiments. Block 153 calls for reaching a transition depth in the borehole from the normal compaction zone to the overpressure zone using the drilling tool and identifying the transition depth from the pore pressure related log using a processor. The transition depth may be identified by the one or more pore pressure related logs. The processor may be included in downhole electronics or in a surface processing system in non-limiting embodiments.

Block 154 calls for calculating pore pressure uncertainty in the overpressure zone from the pore pressure related log in the normal compaction zone using the processor. Alternatively, the pore pressure uncertainty may be calculated from a pore pressure related data value, which may be obtained from the pore pressure related log. The pore pressure related log or data value may also be obtained from a data acquisition tool, which may be the downhole tool or the surface data acquisition tool. The pore pressure uncertainty may be calculated by inputting the pore pressure related log data and pore pressure indicating values relating to the normal compaction trendline into a pore pressure model (e.g., Eq. (1)-(6)). The deviation of the pore pressure calculated using the actual pore pressure related log data from the pore pressure calculated using pore pressure indicating values corresponding to the normal compaction trendline provides a measure of the uncertainty. Data from two or more previously drilled boreholes may be used to generate a curve relating pore pressure uncertainty to q-factor. At least two previously drilled boreholes will provide a minimum level of assurance that the data is applicable to the formation being currently drilled. In a previously drilled borehole, the q-factor is calculated from data from a porosity-indicating log using Methods 1 or 2 for example. In one or more embodiments, a straight line may be drawn through two or more data points obtained from data from two or more previously drilled boreholes. In one or more embodiments, a mathematical function, such as a polynomial, may be used to generate a curve relating uncertainty to q-factor. Hence, once a q-factor is calculated for a borehole being presently drilled, an associated pore pressure uncertainty can be determined using the identified correlation.

Block 155 calls for estimating uncertainty of a pressure window for drilling fluid using the calculated pore pressure uncertainty and applying the estimated uncertainty to the pressure window to provide a modified (e.g., reduced) pressure window that accounts for pore pressure uncertainty using the processor.

Block 156 calls for defining an operating margin and applying the operating margin to the modified pressure window to provide an operating pressure window. The operating margin relates to the distance or margin between the modified drilling pressure window due to pore pressure uncertainty and the operating drilling pressure window that a drilling operator desires to maintain in order to remain within the bounds of the modified drilling pressure window. In one or more embodiments, instrument uncertainty and equipment uncertainty (e.g., pump speed, pump output pressure, and valve position) are used to determine the margins between the drilling pressure window and the operating pressure window. Additional margins may be added to account for unknown factors. By drilling within the operating drilling pressure window (and thus within the modified drilling pressure window due to pore pressure uncertainty), the drilling operator has assurance that the drilling operation will be maintained within the drilling pressure window.

Block 157 calls for defining a drilling parameter for drilling within the operating pressure window. In one or more embodiments, the drilling parameters include drilling fluid weight or density, drilling fluid pump speed, drilling fluid pump output pressure, drilling fluid outlet valve position, a drilling fluid flow rate, an equivalent circulating drilling fluid density, an equivalent static drilling fluid density, and/or a standpipe pressure. And, block 158 calls for drilling into the overpressure zone using the operating pressure window for the drilling fluid. The pressure of the drilling fluid in the borehole annulus downhole is controlled to be within the operating pressure window. In one or more embodiments, the computer processing system 12 is a controller that maintains the pressure of the drilling fluid within the operating pressure window by controlling the drilling fluid pump and/or the drilling fluid flow control valve.

The method 150 may also include monitoring pore pressure to verify the predicted pore pressure uncertainty. If the pore pressure exceeds the uncertainty bounds, then the drilling pressure window and subsequently the operating pressure window can be modified or reduced further to account for the increased uncertainty. The pore pressure can be monitored by the porosity-indicating logs and a model relating porosity to pore pressure or by performing a formation pressure test using a probe (not shown) that seals to a wall of the borehole to measure the formation pressure or other pore pressure related measurements.

The method 150 may include determining at least one pore pressure related trendline using the pore pressure related data value and extrapolating the at least one pore pressure related trendline. Determining here is meant to include calculating, plotting, and/or estimating. The trendline here may include the trendline of the pore pressure related log.

The method 150 may include deriving a representative pore pressure related trendline from the at least one pore pressure related trendline. The representative pore pressure related trendline may be an average, a most frequently measured value, characteristic value (e.g., average) of data interval the measure data falls into.

The method 150 may include monitoring at least one equivalent of drilling fluid pressure and determining if the monitored drilling fluid pressure equivalent is within equivalents of an upper bound and a lower bound of the operating pressure window. Equivalents of drilling fluid pressure may include equivalent static density of the drilling fluid, equivalent circulating density of the drilling fluid, and equivalent drilling fluid weight.

In the method 150, the pore pressure uncertainty may account for at least one of instrument error, equipment calibration error, statistical error of measurement apparatus or method, regression error of trendlines when the trendline comprises a plurality of trendlines, and variation of trendlines when the trendline comprises a plurality of trendlines.

In the method 150, the pressure window may be defined at least in part by a fracture gradient, a pore pressure gradient, and a collapse gradient and the pore pressure uncertainty affects at least partly one of the fracture gradient and the collapse gradient.

In support of the teachings herein, various analysis components may be used, including a digital and/or an analog system. For example, the downhole electronic unit 11, the surface computer processing 12, or the downhole tool 10 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for predicting a pressure window for drilling a borehole in a formation, the method comprising:

obtaining pore pressure related data values of the formation using a data acquisition tool;

identifying at least two sets of pore pressure related data values, the at least two identified sets of pore pressure related data values each comprising at least two pore pressure related data values, the two identified sets of pore pressure related data values being different in at least one pore pressure related data value using a processor;

defining at least two trendlines through the at least two identified sets of pore pressure related data values using the processor, wherein each of the at least two defined trendlines spans a same depth interval of interest and one of the at least two defined trendlines has a slope that is different from a slope of another of the at least two defined trendlines;

predicting a pore pressure uncertainty from the at least two defined trendlines using the processor;

estimating uncertainty of the pressure window for drilling fluid using the predicted pore pressure uncertainty using the processor;

applying the estimated uncertainty to the pressure window to provide a modified pressure window using the processor; and drilling into the formation using a drilling tool and the modified pressure window for the drilling fluid.

2. The method according to claim 1, further comprising defining an operating margin and applying the operating margin to the modified pressure window to provide an operating pressure window using the processor.

3. The method according to claim 2, further comprising monitoring at least one equivalent of drilling fluid pressure and determining when the monitored drilling fluid pressure equivalent is within equivalents of an upper bound and a lower bound of the operating pressure window.

4. The method according to claim 2, further comprising:

defining a drilling parameter for drilling the borehole in the formation within the operating pressure window using the processor; and drilling into the formation using the drilling tool and the operating pressure window for the drilling fluid.

5. The method according to claim 4, wherein the drilling parameter comprises at least one of a drilling fluid density, a drilling fluid flow rate, an equivalent circulating drilling fluid density, an equivalent static drilling fluid density, and a standpipe pressure.

6. The method according to claim 1, further comprising extrapolating the at least two defined trendlines.

7. The method according to claim 6, wherein the pore pressure related data values are obtained from a pore pressure related log acquired by the data acquisition tool.

8. The method according to claim 6, wherein the formation comprises a normal compaction zone and an overpressure zone below the normal compaction zone and wherein the method further comprises defining the at least two defined trendlines from data from the normal compaction zone and extrapolating at least one of the at least two defined trendlines from the data from the normal compaction zone into the overpressure zone.

9. The method according to claim 6, wherein the pore pressure uncertainty accounts for at least one selection from a group consisting of instrument error, equipment calibration error, statistical error of a measurement apparatus or the method, regression error of the at least two defined trendlines, and variation of the at least two defined trendlines.

10. The method according to claim 9, further comprising identifying a correlation between the pore pressure uncertainty and an uncertainty of one of the pore pressure related data values using data from at least two previously drilled boreholes and wherein predicting the pore pressure uncertainty further comprises using the uncertainty of the one of the pore pressure related data values and the correlation.

11. The method according to claim 6, further comprising deriving a representative pore pressure related trendline from the at least two defined trendlines.

12. The method according to claim 6, the method further comprising determining an upper bound line having an upper bound line slope and a lower bound line having a lower bound line slope, wherein the upper bound line slope is less than the slopes of the at least two defined trendlines and the slopes of the at least two defined trendlines are less than the lower bound line slope, the upper bound line indicating positive uncertainty with respect to the at least two defined trendlines and the lower bound line indicating negative uncertainty with respect to the at least two defined trendlines.

13. The method according to claim 12, wherein the upper bound line is a function of an uncertainty of the at least two defined trendlines and the lower bound line is a function of the uncertainty of the at least two defined trendlines.

14. The method according to claim 6, further comprising determining an upper bound line having an upper bound line slope and a lower bound line having a lower bound line slope, wherein the upper bound line is one of the at least two defined trendlines having a minimum slope and the lower bound line is one of the at least two defined trendlines having a maximum slope.

15. The method according to claim 8, wherein predicting the pore pressure uncertainty in the overpressure zone comprises calculating a Q-factor from an upper and a lower bound at depth z that envelope an estimate of a pore pressure related value.

16. The method according to claim 15, wherein Q=constant value q.

17. The method according to claim 1, wherein the pressure window is defined at least in part by a fracture gradient, a pore pressure gradient, and a collapse gradient and the pore pressure uncertainty affects at least partly one of the fracture gradient and the collapse gradient.

18. An apparatus for predicting a pore pressure window for drilling a borehole in a formation, the apparatus comprising:

a data acquisition tool configured to perform formation measurements related to pore pressure of the formation at a plurality of depths in the borehole; and a processor in communication with the downhole data acquisition tool and configured to implement a method comprising:

obtaining pore pressure related data values of the formation from the data acquisition tool;

predicting pore pressure uncertainty from at least two defined trendlines through at least two identified sets of the obtained pore pressure related data values, wherein the at least two identified sets of pore pressure related data values each comprising at least two pore pressure related data values, the at least two identified sets of pore pressure related data values being different in at least one pore pressure related data value, and wherein each of the at least two defined trendlines spans a same depth interval of interest and one of the at least two defined trendlines has a slope that is different from a slope of another of the at least two defined trendlines;

estimating uncertainty of the pressure window for drilling fluid using the predicted pore pressure uncertainty; and applying the estimated uncertainty to the pressure window to provide a modified pressure window; and a drilling tool configured to drill the borehole using the modified pressure window.

19. The apparatus according to claim 18, wherein the apparatus is further configured to apply an operating margin to the modified pressure window to provide an operating pressure window.

20. The apparatus according to claim 19, wherein the drilling tool is configured to drill the borehole within the operating pressure window.

21. The apparatus according to claim 19, further comprising a controller configured to control a drilling fluid pump or a drilling fluid control valve to maintain drilling fluid pressure equivalent within the operating pressure window.

22. The apparatus according to claim 19, further comprising a controller configured to control a drilling fluid control valve to maintain drilling fluid pressure within the operating pressure window.

23. The apparatus according to claim 19, further comprising a drilling fluid sensor configured to sense a drilling fluid parameter and to provide input to a controller configured to maintain drilling fluid pressure within the operating pressure window.

24. The apparatus according to claim 18, wherein the data acquisition tool comprises at least one of a gamma ray tool, a resistivity tool, a dielectric permittivity tool, a density tool, a neutron porosity tool, a pulsed neutron tool, a nuclear magnetic resonance tool, and an acoustic tool.

25. The apparatus according to claim 18, wherein the data acquisition tool is configured to acquire formation data at the surface of the formation.

* * * * *